US005435031A

United States Patent [19]

Minami et al.

[11] Patent Number: 5,435,031

[45] Date of Patent: Jul. 25, 1995

[54] AUTOMATIC POOL CLEANING APPARATUS

[75] Inventors: Don S. Minami, Monte Sereno; Michael J. Shawver, Castro Valley, both of Calif.; Thomas P. Jensen, Boise, Id.; Lawrence A. Shubert, San Francisco; Kenneth N. Marshall, Novato, both of Calif.

[73] Assignee: H-Tech, Inc., Wilmington, Del.

[21] Appl. No.: 89,653

[22] Filed: Jul. 9, 1993

[51] Int. Cl.[6] ..... E04H 4/16

[52] U.S. Cl. ..... 15/1.7

[58] Field of Search ..... 15/1.7, 319

[56] References Cited

U.S. PATENT DOCUMENTS

| | | | |
|---|---|---|---|
| 4,521,933 | 6/1985 | Raubenheimer | 15/1.7 |
| 4,536,908 | 8/1985 | Raubenheimer | 15/1.7 |
| 5,086,535 | 2/1992 | Grossmeyer et al. | 15/319 |
| 5,197,158 | 3/1993 | Moini | 15/1.7 |
| 5,256,207 | 10/1993 | Sommer | 15/1.7 |
| 5,337,434 | 8/1994 | Erlich | 15/1.7 |

FOREIGN PATENT DOCUMENTS

| | | | |
|---|---|---|---|
| 0314259 | 6/1985 | European Pat. Off. | E04H 3/20 |
| 0352487 | 6/1989 | European Pat. Off. | E04H 4/16 |
| 0483677 | 10/1991 | European Pat. Off. | E04H 4/16 |

OTHER PUBLICATIONS 1-page advertisement entitled "Aquabot Turbo Remote Control," published in Spring 1992 issue of *Poolife* magazine.

2-page brochure entitled "The Aquabot Turbo," Aquaproducts, Cedar Grove, N.J.

4-page brochure entitled "The Aquabots," No. 87/003, Aqua Products, Inc. Cedar Grove, N.J.

2-page brochure entitled "The Aquabots-Mark V," No. 88/004, Aqua Products Inc., Cedar Grove, N.J. (1988).

3-page brochure entitled "The Aquabot Formula Automatic Pool Cleaner," AquaProducts, Inc. Cedar Grove, N.J. (Aug. 1, 1990).

2-page brochure entitled: "The Formula Automatic Pool Cleaner".

4-page brochure entitled "Dolphin by Maytronics," Maytronics (Nov. 1991).

2-page brochure entitled "Built to Endure," Aqua Vac Systems, Inc., Boynton Beach, Fla.

4-page brochure entitled "Weda Poolcleaners," Weda Pump AB (Sweden)(1991).

1-page brochure entitled "Robotech-the Automatic Pool Cleaner Line," *Pool & Spa News,* May 1992.

4-page advertisement entitled "Vacuums as it sweeps, as it cleans, as it filters." International Pool and Spa Show (1989).

International Search Report from the International Searching Authority, dated Nov. 24, 1994, 8 pages in length.

*Primary Examiner*—Edward L. Roberts, Jr.

*Attorney, Agent, or Firm*—Limbach & Limbach

[57] ABSTRACT

An apparatus for automatically cleaning submerged surfaces, such as the bottom and side walls of a swimming pool. In a preferred embodiment, the apparatus includes onboard sensors, and an onboard processor (preferably, a microprocessor) which controls operation of the apparatus in response to status information supplied from the sensors. Preferably, the apparatus has an onboard watertight battery and an adjustable inlet nozzle size, and includes left and right track treads which are controllable to cause the apparatus to turn or rotate (clockwise or counterclockwise), or translate in a forward or reverse direction, on a horizontal or vertically inclined submerged surface. A transmission assembly is provided for each track tread, including a cam wheel and a cam follower connected thereto within a sealed control assembly, and a shift link extending through a seal in the control assembly. Each shift link has an end connected to one of the cam followers and another end connected to a gear assembly, for shifting the gear assembly into a forward or a reverse gear. The apparatus preferably includes Hall effect transducers (with associated permanent magnets) and a microprocessor mounted within a sealed control assembly. The microprocessor is programmed to execute a selected one of a number of cleaning programs (thereby entering a selected operating mode) in response to exposure of the Hall effect transducers to a magnetically permeable card punched with specially arranged holes, or a card with a magnetically permeable insert molded within it.

48 Claims, 26 Drawing Sheets

AUTOMATIC POOL CLEANING APPARATUS

FIELD OF THE INVENTION

The invention relates to an apparatus for automatically cleaning submerged surfaces, such as the bottom and side walls of a swimming pool filled with water. More particularly, the invention relates to an apparatus for cleaning a submerged surface, including onboard processing means for controlling operation of the apparatus in response to status information supplied from onboard sensors.

BACKGROUND OF THE INVENTION

One conventional device for cleaning a submerged surface (such as the bottom of a swimming pool filled with water) is designed to move randomly along the submerged surface. One such device is described in U.S. Pat. No. 4,521,933, issued Jun. 11, 1985 to Raubenheimer. The Raubenheimer device is designed for connection, by a flexible tube, to a suction apparatus disposed on the surface. While the surface apparatus pumps a stream of water up through the tube, a turbine within the bottom device is caused to rotate by the flowing stream. The rotating turbine, in turn, actuates components which cause the device to "walk" on the submerged surface on pivoting feet composed of a thermoplastic elastomer. A second turbine assembly causes the device to turn (from time to time) in a randomly determined direction.

SUMMARY OF THE INVENTION

The invention is an apparatus for automatically cleaning submerged surfaces, such as the bottom and side walls of a swimming pool filled with water. In a preferred embodiment, the apparatus includes onboard sensors, and an onboard processor which controls operation of the apparatus in response to status information supplied from the sensors. The status information can command the processor to execute one of several preprogrammed programs (or branches of programs), and thus to operate in one of several corresponding predefined modes.

In another preferred embodiment, the apparatus includes left and right track treads which are individually controlled to cause the apparatus to rotate (clockwise or counterclockwise) or translate (in a forward or reverse direction) on a horizontal or vertically inclined surface (such as a sloping swimming pool wall). A transmission assembly is provided for each track tread. Each transmission assembly includes a cam wheel and a cam follower connected to the cam wheel in the interior of a sealed control assembly, and a shift arm extending through a seal in the control assembly. Each shift arm has an end connected to one of the cam followers and another end connected to a gear assembly for shifting the gear assembly into a forward, reverse, or neutral gear. Each transmission assembly is controlled by a shift arm and cam follower. A single camshaft positioned by a microprocessor-controlled stepper motor rotates the cam wheels to actuate the cam followers, thereby actuating the shift arms. The camshaft has eight positions, with each position placing the left and right shift arm pair in a different one of the following configurations: forward/forward (for forward motion), neutral/forward (for a left turn), reverse/forward (for a sharp left turn), forward/neutral (for a right turn), forward/reverse (for a sharp right turn), reverse/neutral (for reverse left turn), neutral/reverse (for reverse right turn), and neutral/neutral (for idling, to maximize the life of the mechanism). In variations on this embodiment, the camshaft has a position for placing the shift arm pair into a reverse/reverse configuration.

The inventive apparatus preferably includes a set or array of magnetically actuated switches (such as Hall effect transducers or reed switches, with associated permanent magnets) and a processor mounted within a sealed control assembly. In such embodiments, portions of the control assembly walls are made of material (such as plastic) that will not magnetically shield the interior of the control assembly. The processor is pre-programmed (with software or firmware) to execute any of a number of different programs, each of which will cause the apparatus to operate in a different mode. Commands are entered to the processor to cause the processor to execute selected ones of the programs, by exposing the magnetically actuated switches to programming cards made of magnetically permeable material.

Each card can be punched with specially arranged holes, or can have a specially shaped insert molded within it. In the latter case, the insert should have a different magnetic permeability than the surrounding portion of the card. For example, a specially shaped metal insert (e.g., a stamped sheet metal insert) can be molded within a plastic card. When the card is positioned close to the magnetic switches (preferably at a station outside the sealed walls of the control assembly), the presence or absence of a hole (or metal insert portion) near each switch causes each transducer to assert a signal (e.g., a binary zero or one) to the microprocessor, to command the microprocessor to execute one of several pre-programmed programs (and thus operate in one of several corresponding predefined modes). Examples of such predefined operating modes include cleaning patterns specially suited for cleaning rectangular-shaped or kidney-shaped swimming pools, patterns for cleaning only a portion of a pool such as the bottom surface, and cleaning procedures for cleaning different types of pool surface media (such as concrete or vinyl). The operating modes can also define the length of time for a given cleaning cycle so that cleaning time can be optimized for a given pool size. Thus, the cleaner can be programmed to operate only as long as needed to clean a given size of pool.

The holes through each card can be patterned (or an insert within each card shaped) so that the control code defined by the card depends on the orientation of the card relative to the magnetically actuated switch array. Thus, if the card is square-shaped and sized for insertion against a square-shaped card reading location (e.g., a recessed window) of a control assembly wall, the card can define eight different control codes depending on which edge of the card faces a particular edge of the card reading location and which face of the card faces the wall. More generally, the card can have any polygonal shape (i.e., hexagonal or rectangular) and can be sized for insertion against a card reading location of corresponding (polygonal) shape.

In alternative embodiments, the programming card is designed to selectively actuate a mechanical or optical switch (rather than a magnetic switch), and commands are entered to the processor by exposing arrays of mechanically or optically actuatable switches to such a programming card.

In any embodiment of the invention, the programming card can be coded with a pattern of notches at along its edges. When the notched card is placed into position adjacent the magnetic (or optical or mechanical) switches, the card will (or will not) actuate mechanical means for controlling the size of a turbine assembly fluid inlet nozzle depending on the absence (or presence) of a notch at the location of the mechanical means. Selection of a larger inlet size results in slower, more thorough, cleaning than is normally achievable with a smaller turbine inlet. The larger inlet will also allow for passage of larger debris. The smaller inlet will give higher turbine speed resulting in greater unit velocity and also increase torque for better wall climbing.

In preferred embodiments, the inventive apparatus is powered by an onboard battery pack sealed in a watertight enclosure. Use of such a battery pack enables safer and more convenient operation than can by achieved with pool cleaners which have employed a power cable extending to the submerged apparatus from a power supply disposed above the water surface.

DETAILED DESCRIPTION OF THE PREFERRED EMBODIMENTS

Figure 1:
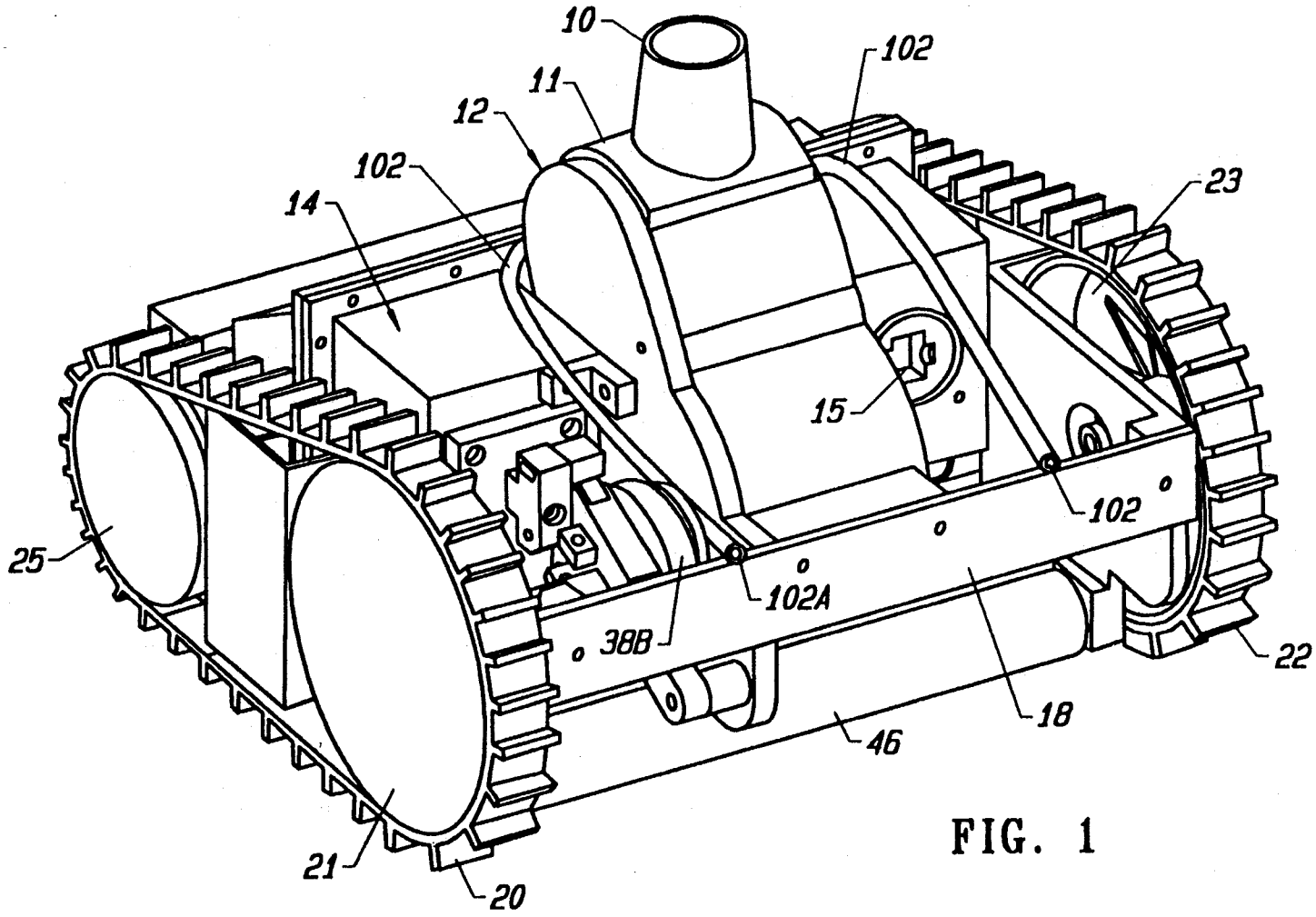
FIG. 1 is a front perspective view of a first embodiment of the inventive apparatus.

The invention will be described in an important residential application in which it is employed to clean the bottom and sidewalls of a swimming pool filled with water. The inventors contemplate that the invention is also useful for other applications, e.g., to clean other surfaces submerged in water or in liquids other than water. The term "water" will be used in a broad sense throughout the specification, including in the claims, to denote fresh water, salt water, and any other liquid in which a surface (to be cleaned by the inventive apparatus) is immersed.

A first embodiment of the invention will be described with reference to FIGS. 1–8 and 11–22. In this embodiment, the invention includes a turbine assembly 12 having an inlet 9 (shown in FIGS. 4 and 13) and an outlet 10. Outlet 10 is dimensioned for attachment to the lower end of a flexible hose 8 (shown only in FIG. 13), and so outlet 10 is sometimes referred to herein as a "hose connection" 10. Typically, the upper end of hose 8 will be connected to one of the pool's existing suction ports, which in turn is connected to a conventional surface unit 8A (shown in FIG. 13) disposed above the water surface. The surface unit will typically include a filter, and a pump for pumping a stream of water (which can be, but need not be, debris-containing water) from inlet 9 to outlet 10 and then up through hose 8 (for example, to a suction port and then to a surface filter which removes debris from the flowing stream).

The inventive apparatus preferably has slight negative buoyancy, sufficient to cause it to sink to the submerged surface to be cleaned (e.g., a swimming pool bottom twelve feet deep) with hose 8 connecting it to the surface unit via the suction port.

An impeller 40 (shown in FIGS. 3 and 4) is rotatably mounted within turbine assembly 12. Water pumped upward through turbine assembly 12 by the surface unit exerts a torque on impeller 40, causing impeller 40 to rotate. Impeller 40 is coupled to right drive wheel 21 and left drive wheel 23 (by means to be described below) in such a manner that rotating impeller 40 drives wheels 21 and 23 (energy is transferred from rotating impeller 40 to wheels 21 and 23 to rotate the wheels). Alternatively, energy is transferred (by other means) from the flowing water pumped through turbine assembly 12 to cause rotation of wheels 21 and 23.

Controllable right and left transmission assemblies (to be described below) are connected between impeller 40 and wheels 21 and 23, respectively. As impeller 40 rotates, either or both of the transmissions can be engaged to drive either or both of wheels 21 and 23 in clockwise or counterclockwise directions to determine the direction of motion of the inventive device. Or, either or both of the transmissions can be disengaged to decouple either or both of wheels 21 and 23 from impeller 40.

Right tread 20 is looped around rear wheel 25 and front wheel 21, and left tread 22 is looped around rear wheel 27 (shown in FIG. 3) and front wheel 23. When the right and left transmissions drive wheels 21 and 23 in the same direction (e.g., clockwise), the inventive apparatus will translate in a forward (or reverse) direction, as treads 20 and 22 grip, the submerged surface. When the right and left transmissions drive wheels 21 and 23 in opposite directions, treads 20 and 22 rotate the apparatus (about an axis normal to the surface on which the apparatus travels).

It should be appreciated that alternative embodiments of the invention may employ traction means other than right and left drive wheels 21 and 23 in combination with right and left treads 20 and 22. For example, the invention could alternatively employ left and right turbines as its traction means. Such left and right turbines would be selectively controllable by left and right control ("transmission") assemblies.

Figure 27:
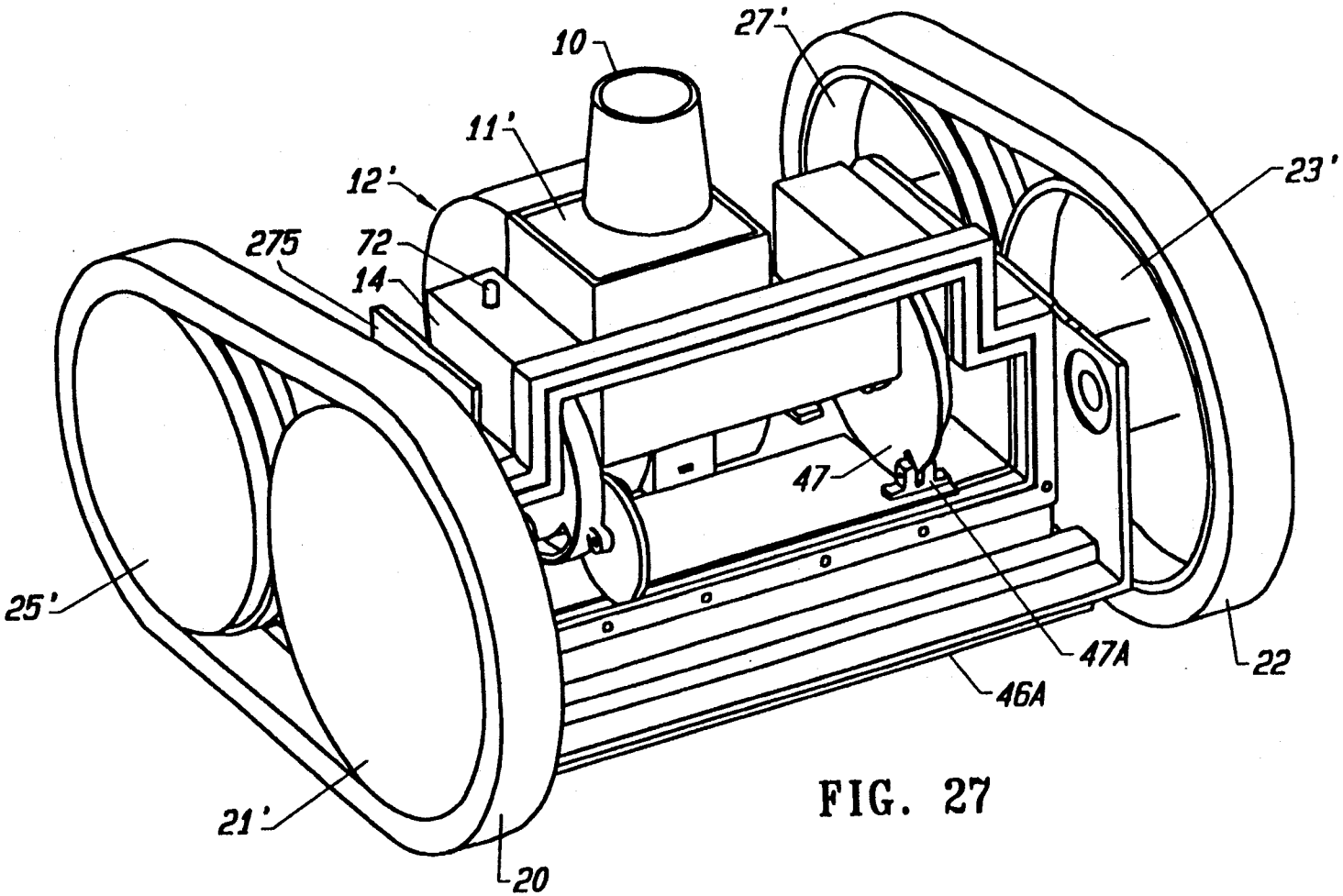
FIG. 27 is a front perspective view of a preferred embodiment of the inventive apparatus.
Figure 28:
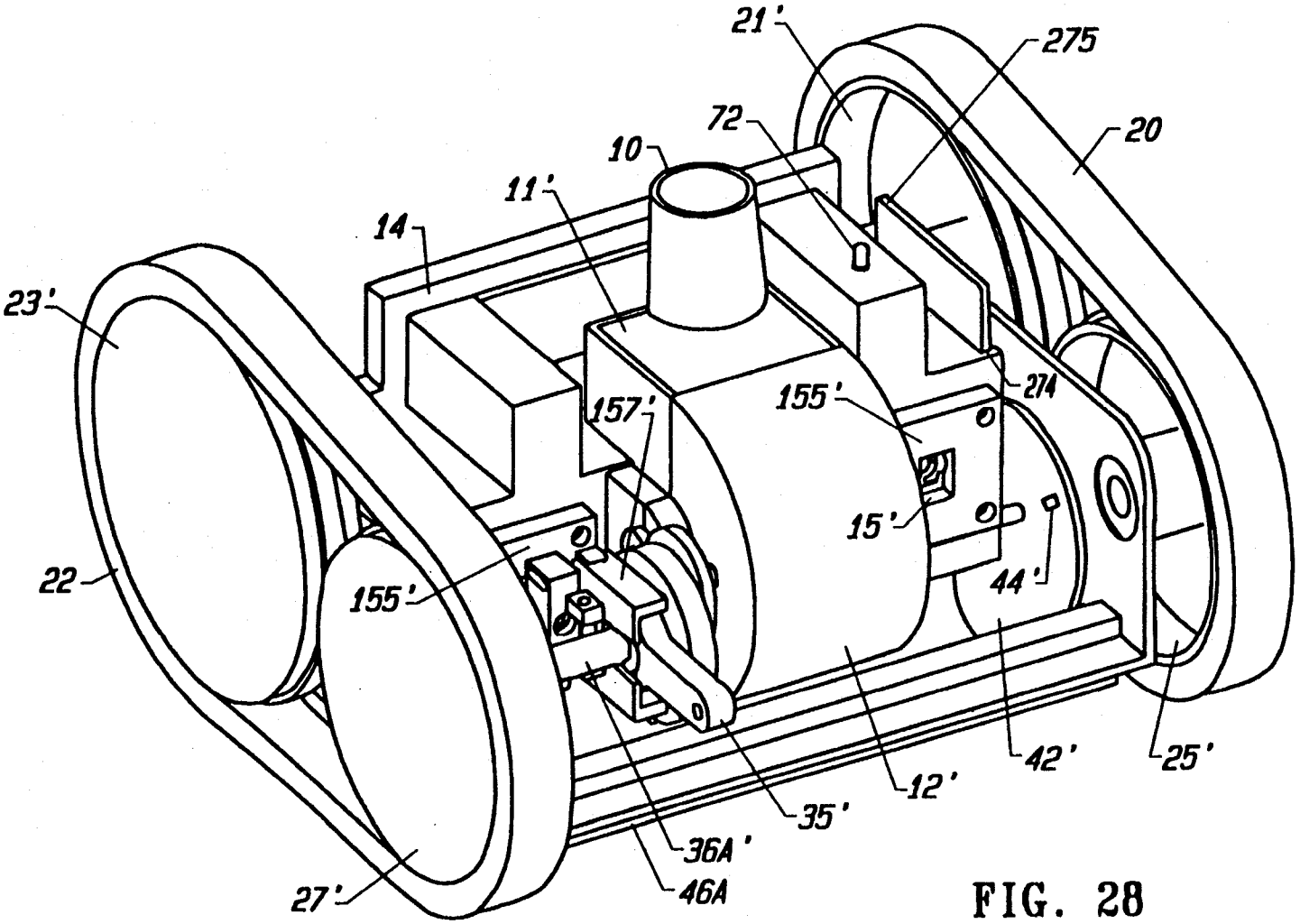
FIG. 28 is a rear perspective view of the FIG. 27 apparatus.

Roller brush 46 (shown in FIGS. 1, 4, and 5, and more clearly shown in FIG. 6) is rotatably mounted on body 18 of the inventive apparatus, in a position contacting the submerged surface being cleaned. Brush 46 rotates passively (against brush bearings 38, shown in FIG. 6) when track treads 20 and 22 translate the inventive apparatus along the submerged surface. In the preferred embodiment to be described with reference to FIGS. 27 and 28, roller brush 46 is replaced by two fixedly mounted straight brushes **46*a*. One of brushes 46*a* is mounted at the front of the apparatus (as shown in FIG. 27), and the other is mounted at the rear of the apparatus (as shown in FIG. 28). In the alternative embodiment shown in FIG. 25, housing member 18 is designed so that roller brush 46 can be rotatably mounted to it, or straight brush 46*a* can be fixedly mounted to it. In other alternative embodiments, the inventive apparatus can be equipped with no brushes at all, or with one or more actively powered brushes, or passive brushes in addition to roller brush 46 or straight brush 46*a***.

The structure of turbine assembly 12 will next be described with reference to FIGS. 3 and 8. Assembly 12 includes left and right turbine housing members **39*a* and 39*b*, which are assembled together to enclose impeller 40, with their assembled lower edges defining inlet 9. Right shaft 40*b* and left shaft 40*a* of the rotating impeller 40 ride on impeller bearings 40*c* as shafts 40*b* and 40*a* extend through openings in members 39*b* and 39*a*, respectively. The outer ends of shafts 40*b* and 40*a*, or gears (not shown) attached thereto, engage, respectively, larger gears 32*a* of left and right gear clusters 32. Both gear clusters are shown in FIG. 3, but only right gear cluster 32 is shown in FIG. 8**.

Figure 3:
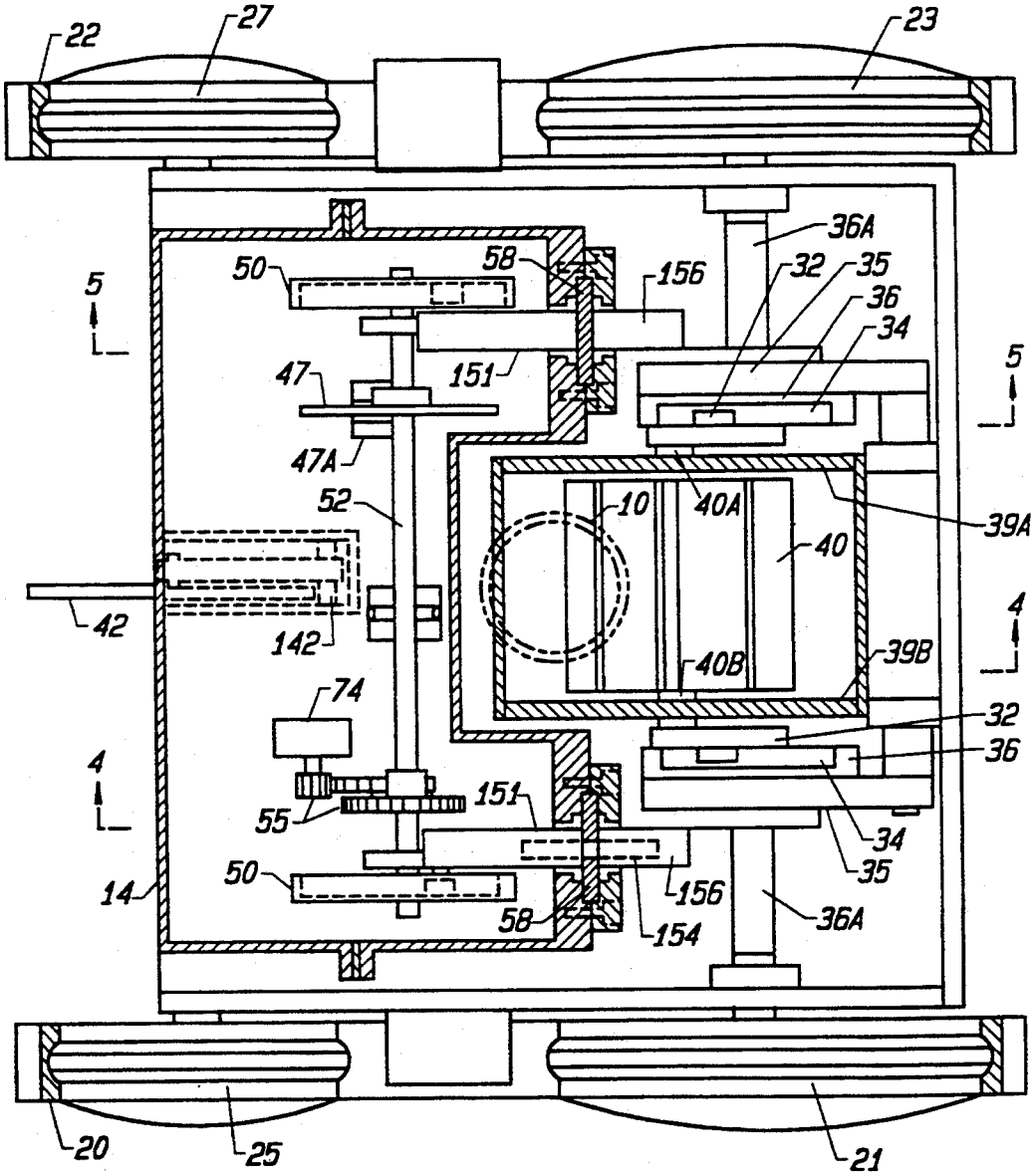
FIG. 3 is a top elevational view of the FIG. 1 apparatus.
Figure 4:
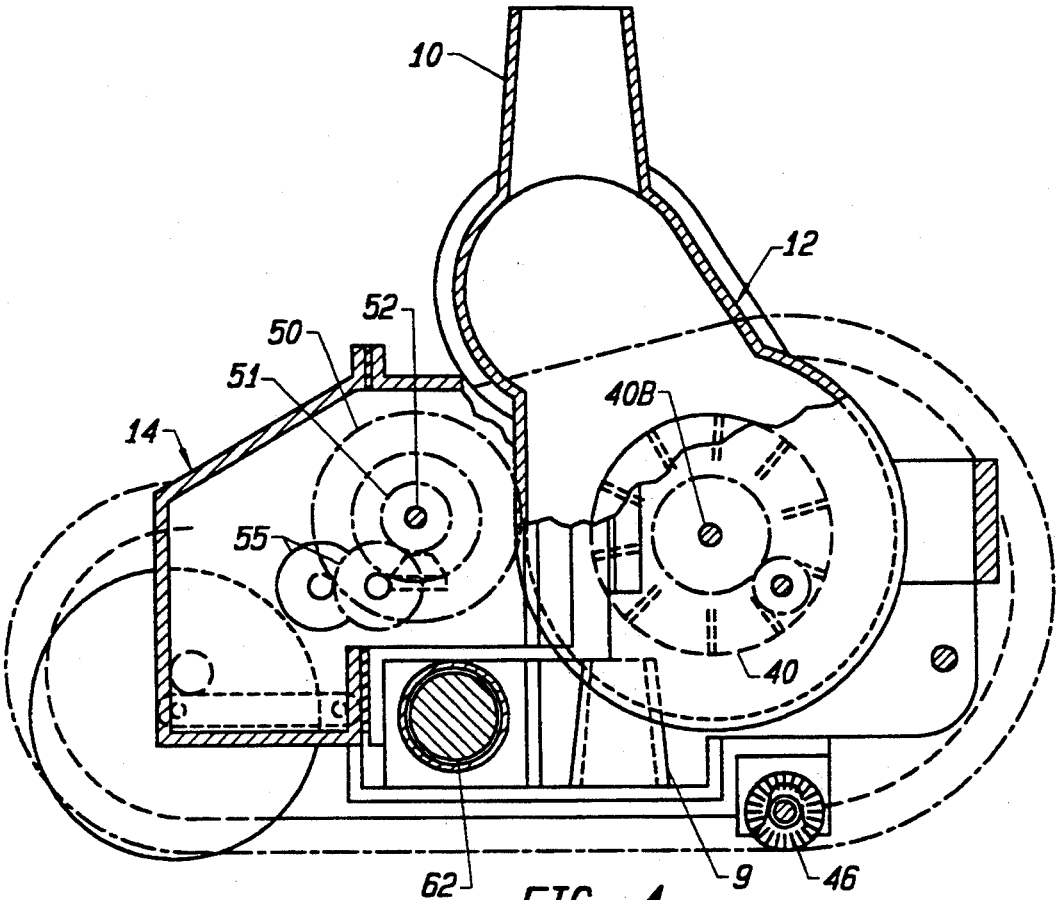
FIG. 4 is a simplified side cross-sectional view of the FIG. 3 apparatus, taken along line 4—4 of FIG. 3.
Figure 5:
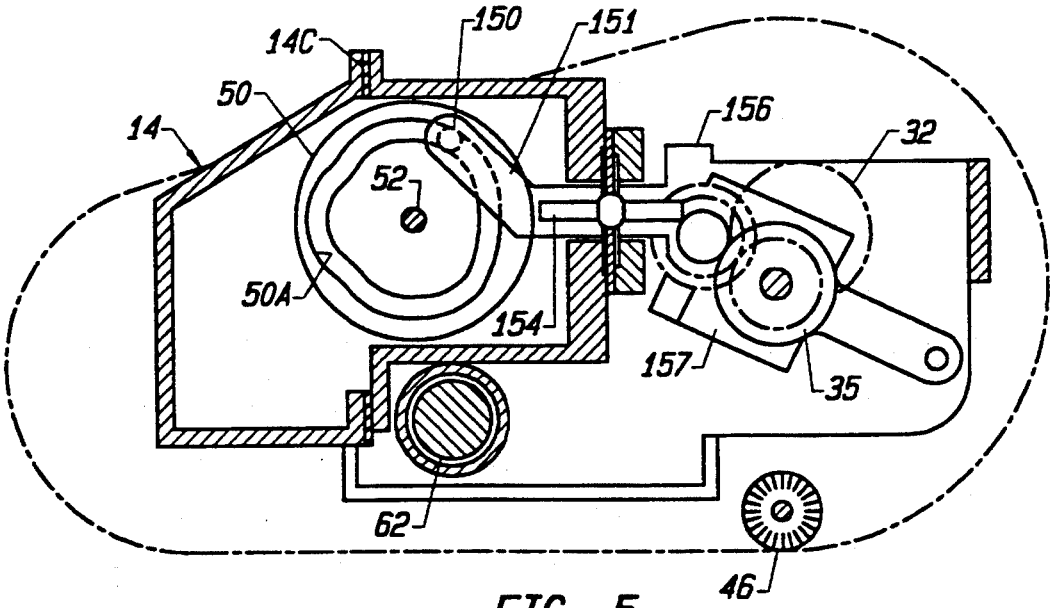
FIG. 5 is a simplified side cross-sectional view of the FIG. 3 apparatus, taken along line 5—5 of FIG. 3.
Figure 6:
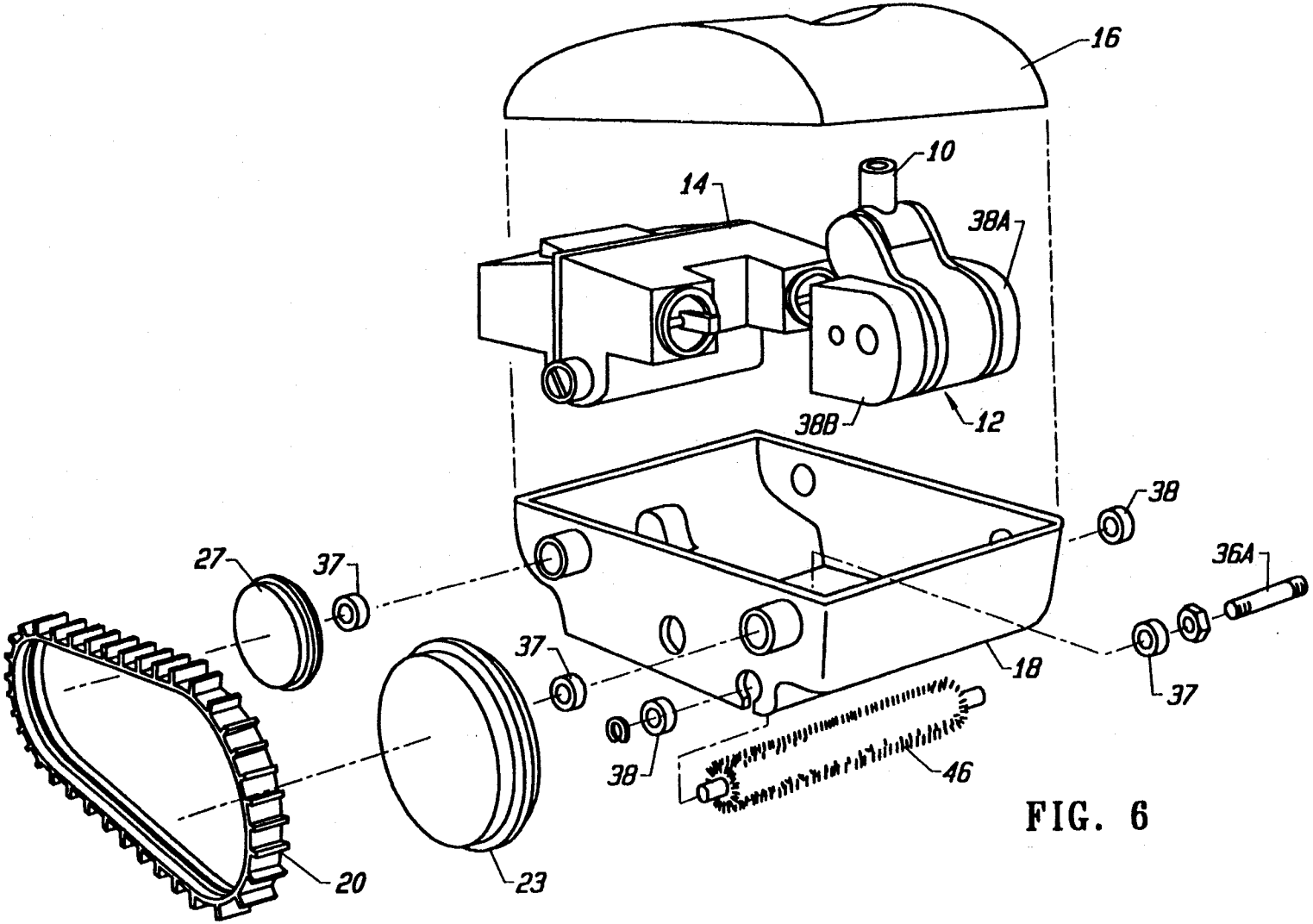
FIG. 6 is an exploded perspective view of a portion of the drive components of the FIG. 1 apparatus.
Figures 8, 9, 10, 11, 12:
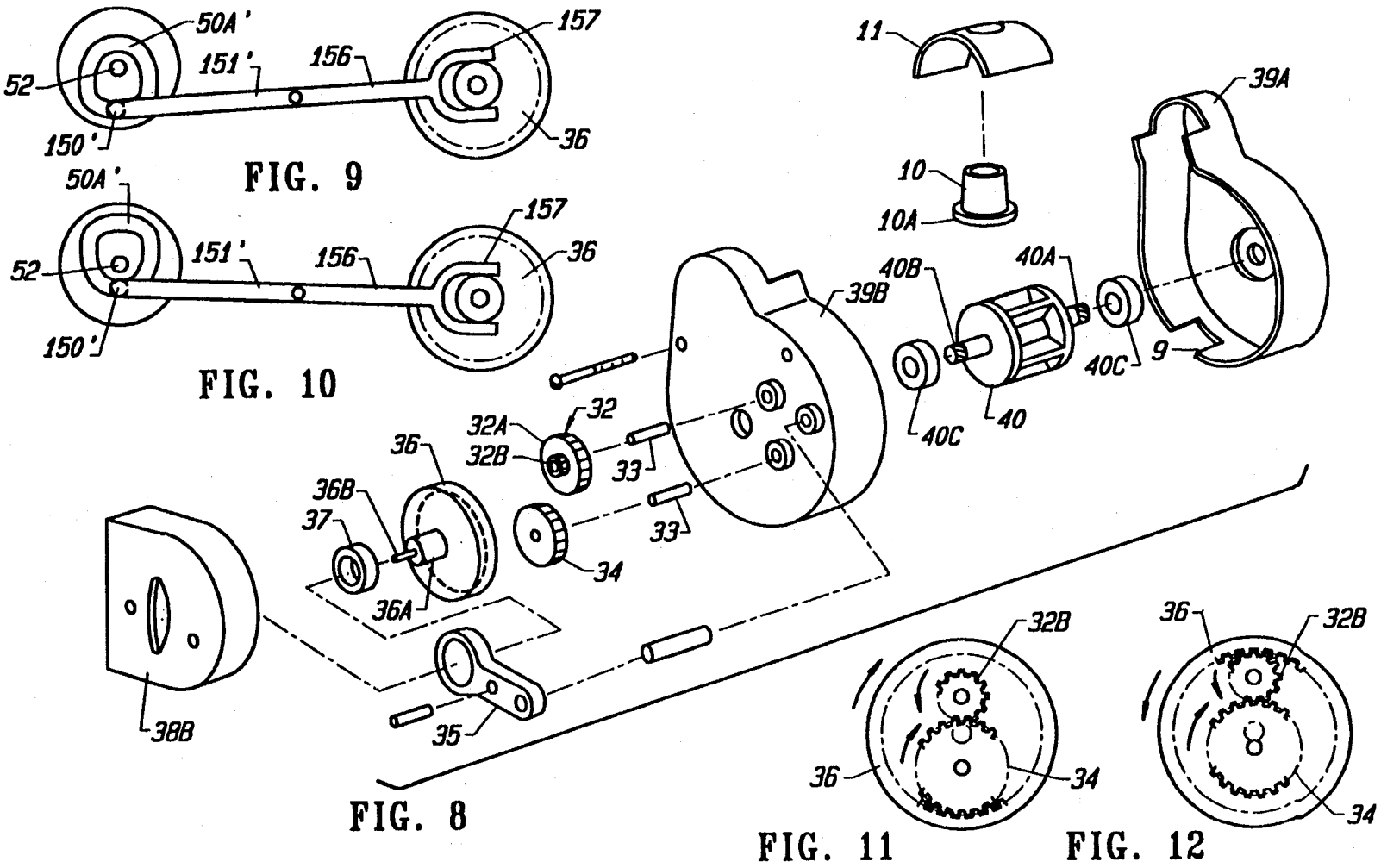
FIG. 8 is an exploded perspective view of the turbine assembly of the FIG. 1 apparatus.
FIG. 9 is a simplified side elevational view of the cam-driven shifting mechanism of the inventive apparatus, in a first position.
FIG. 10 is a side elevational view of the cam-driven shifting mechanism of FIG. 9, in a second position.
FIG. 11 is a side elevational view of the transmission gear portion of the shifting mechanism of FIG. 8, with the shifting mechanism in a position for forward rotation of the corresponding wheel.
FIG. 12 is a side elevational view of the transmission gear portion of the shifting mechanism of FIG. 8, with the shifting mechanism in a position for reverse rotation of the corresponding wheel.
Figure 13:
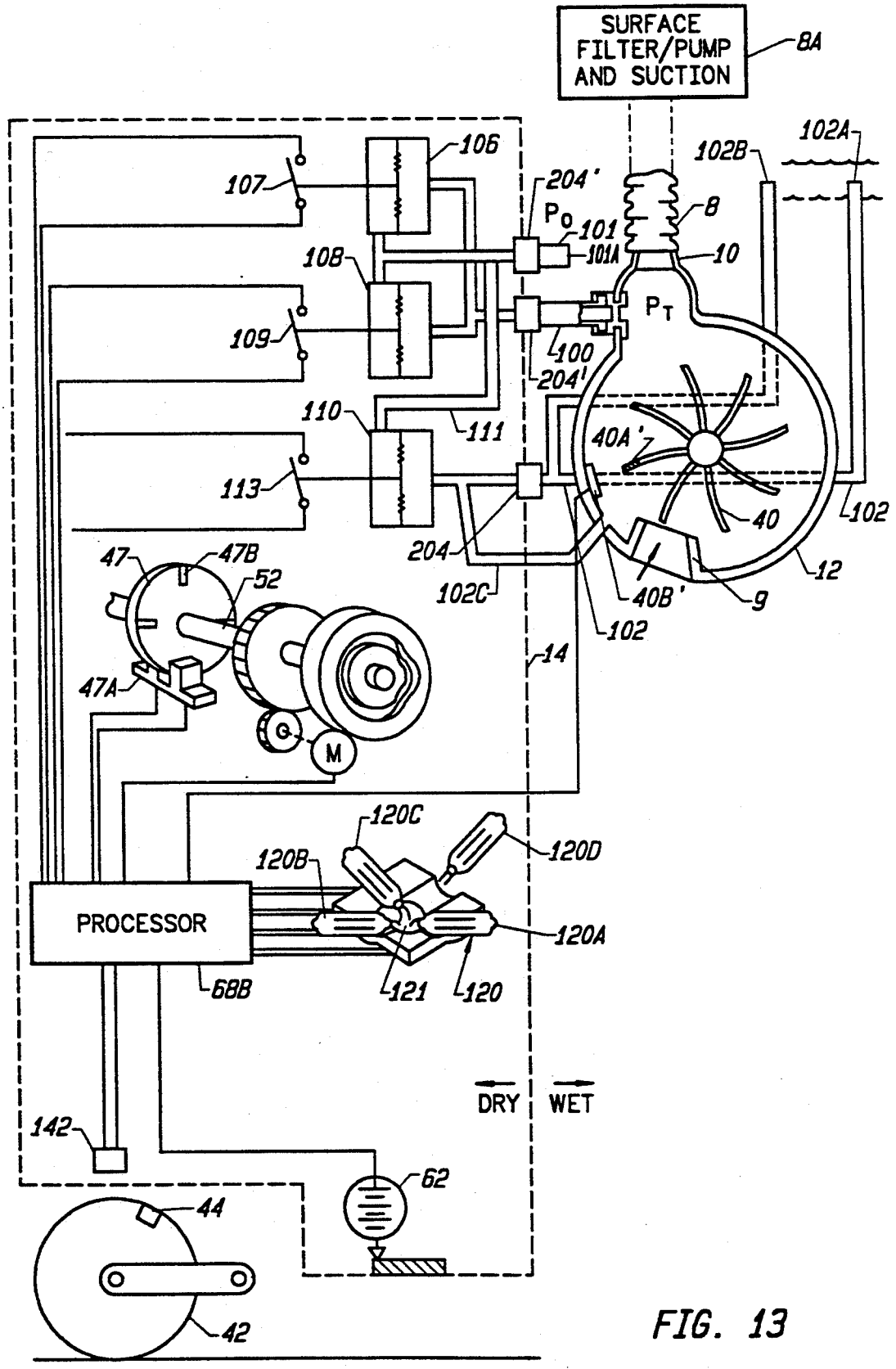
FIG. 13 is a schematic diagram representing sensors employed in the FIG. 1 apparatus, and an interface circuit and processor for processing output signals produced by the sensors.

Hose connection 10 is shown in phantom view in FIG. 3, and is shown in more detail in FIG. 8. As shown in FIG. 8, hose connection 10 is preferably mounted so as to extend through frame 11, and frame 11 is attached to the upper edges of assembled members **39*a* and 39*b*. Hose connection 10 has a bearing portion 10*a*, which is designed to rotate with low friction relative to frame 11. Thus, frame 11 and the rest of the inventive apparatus are free to rotate as a unit relative to the assembly comprising hose connection 10 and hose 8 (which are sealingly connected to each other as shown in FIG. 13), while frame 11 and bearing 10*a* prevent fluid from leaking into the turbine assembly from outside the turbine assembly (except through inlet 9**).

Gear cluster 32 and idler gear 34 are rotatably mounted on shafts 33 to each of members **39*a* and 39*b*. Smaller gear 32*b* of each cluster 32 engages idler gear 34. Thus (as shown in FIGS. 11 and 12**), when impeller 40 rotates clockwise, it causes gear cluster 32 to rotate counterclockwise, and rotating gear 32*b* in turn causes gear 34 to rotate clockwise.

Figure 7:
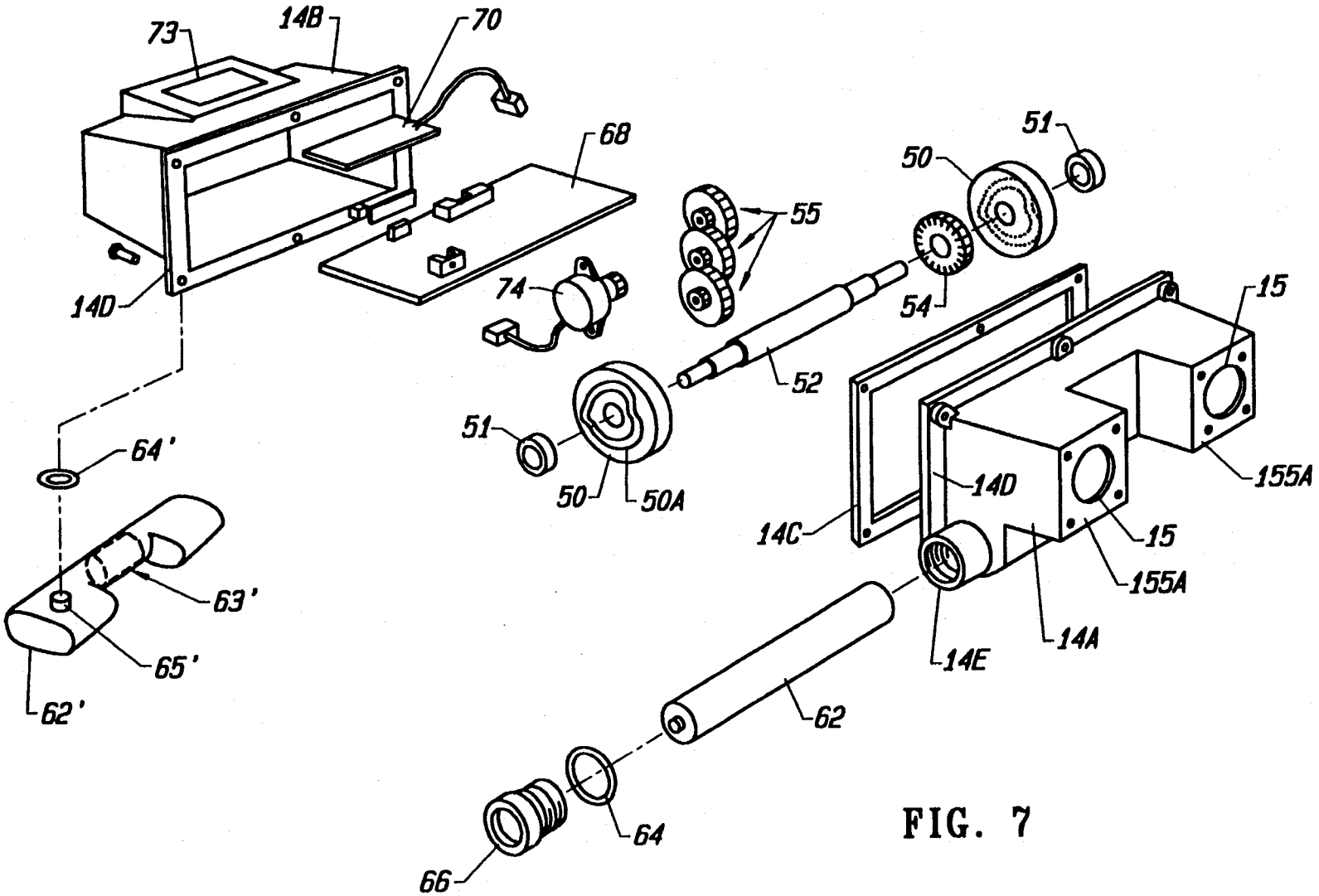
FIG. 7 is an exploded perspective view of the control box of the FIG. 1 apparatus (including some of the components mounted in its interior).
Figure 7A:
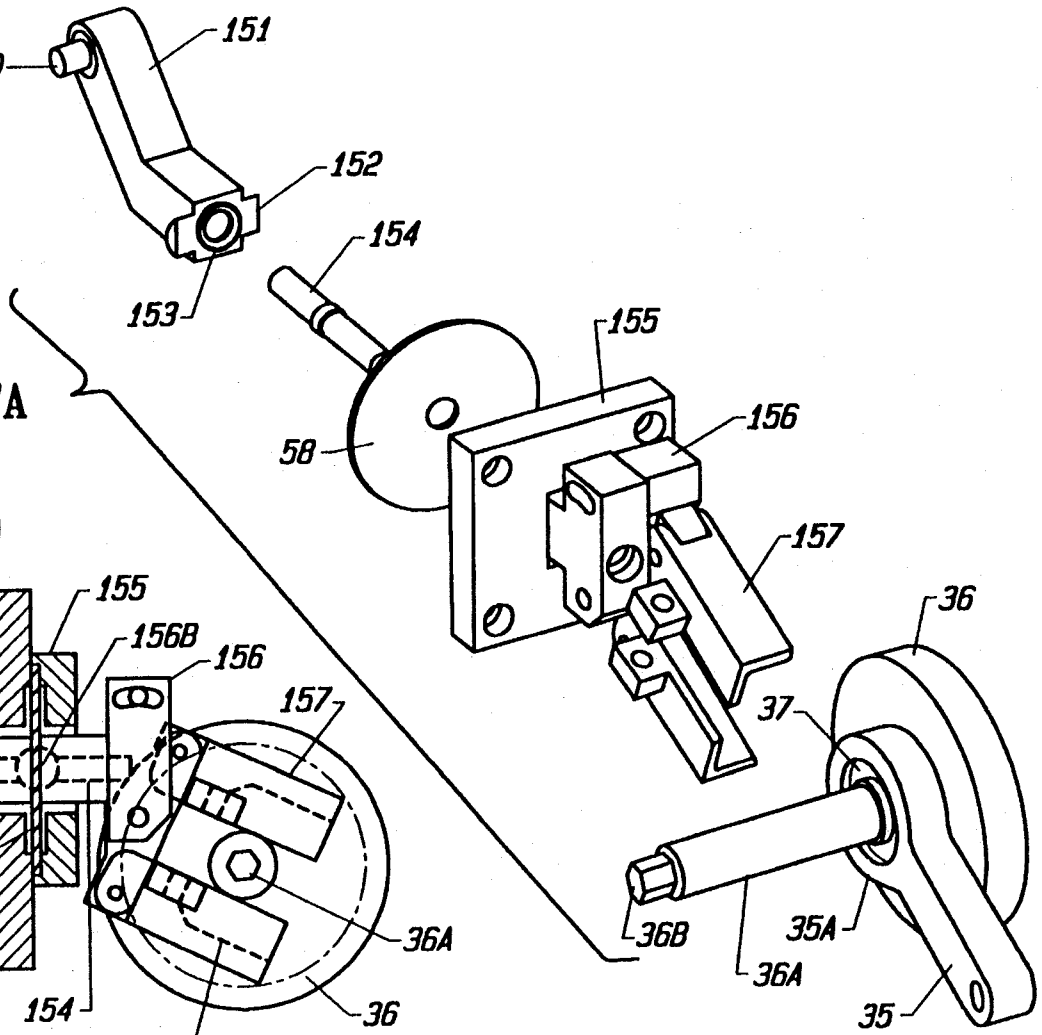
FIG. 7A is an exploded perspective view of the cam-driven shifting mechanism of the FIG. 1 apparatus (a portion of which is mounted within the control box thereof).

Axle 36*a* has a universal joint at location 36*b* at each end (only one location 36*b* is visible in FIG. 7A and in FIG. 8). One universal joint of axle 36*a* is connected to ring gear 36, and the other universal joint is connected to apparatus drive wheel 21 (or 23). Axle 36*a* extends through pivoting control arm 35, in such a manner that gear 36 is free to rotate relative to arm 35, and arm 35 is free to pivot relative to housing member 39*b*. Transmission cover 38*b* encloses the assembly comprising gears 32, 34, and 36, arm 35, ring gear bearing 37, and shift links 156 and 157 (to be discussed below) at the right side of the inventive apparatus, with the right axle 36*a* extending out from a hole through cover 38*b*. Similarly, transmission cover 38*a* encloses a similar assembly comprising gears 32, 34, and 36, arm 35, ring gear bearing 37, and shift links 156 and 157 at the left side of the inventive apparatus, with the left axle 36*a* extending out from a hole through cover 38*a*. Rotating axles 36*a* at the right and left sides of the apparatus drive wheels 21 and 23, respectively.

To shift right wheel 21 into a "forward" rotational direction (i.e., clockwise in FIG. 1), a "right side" shift assembly comprising link 151, tube 154, link 156, and fork 157 (shown in FIG. 7B) pivots upward, thus moving gear 36 upward into engagement with idler gear 34 (into the position shown in FIG. 11), and pivoting control arm 35 relative to housing member 39*b*. In this position, as gear cluster 32 causes idler gear 34 to rotate clockwise, idler gear 34 in turn causes ring gear 36 (and hence wheel 21) to rotate clockwise.

To shift wheel 21 into a "reverse" rotational direction (i.e., counterclockwise in FIG. 1), the shift assembly comprising link 151, tube 154, link 156, and fork 157 will pivot downward, thus pulling gear 36 downward (into the position shown in FIG. 12) into, direct engagement with gear 32*b* and out of engagement with idler gear 34 (and pivoting arm 35 in the opposite direction relative to housing member 39*b*. In this position, as gear cluster 32 rotates counterclockwise, gear 32*b* causes ring gear 36 (and hence wheel 21) to rotate counterclockwise.

Similarly, in order to shift left wheel 23 into a "reverse" rotational direction, a "left side" shift assembly comprising link 151, tube 154, link 156, and fork 157 (within cover 38*a*) would pivot down to engage the left gear 36 with the left gear 32*b*, and in order to shift wheel 23 into a "forward" rotational direction, the same "left side" shift assembly would pivot upward to engage the left gear 36 with the left idler gear 34.

All the drive train components shown in FIG. 8 are subject to exposure to the liquid environment in which the inventive apparatus operates. The drive train components need not be mounted in a sealed enclosure, and need not be otherwise isolated from the liquid (although they could be so isolated in alternative embodiments of the invention). Several of the inventive onboard sensors (for supplying status information to the onboard microprocessor) are similarly mounted in positions exposed to the surrounding liquid environment.

In contrast, the FIG. 7 components (including the microprocessor and related control circuitry, and the transmission hardware to be described below) and the onboard sensors shown in FIGS. 13, 18, and 21 (represented by blocks in FIG. 23), which together comprise control box assembly 14, are mounted in a sealed enclosure to isolate them from the surrounding liquid. The sealed enclosure includes control box portions 14*a* and 14*b*, gasket 14*c*, and identical left and right diaphragm seals 58 (shown in FIG. 3) mounted over left and right openings 15 of portion 14*a*. To form the sealed enclosure, portions 14*a* and 14*b* are assembled together with their matching rectangular edge portions 14*d* adjacent to one another, with rectangular gasket 14*c* pressed between the matching edge portions 14*d*.

As indicated in FIG. 7, main electronic circuit board 68 is mounted in the dry environment inside assembled elements 14*a*, 14*b*, and 14*c*. The circuitry mounted on board 68, which includes processor 68*b* (an electronic microprocessor), will be discussed below in detail with reference to FIG. 23.

Input/output electronic circuit board 70 is electrically connected to board 68, and mounted within assembled elements 14*a*, 14*b*, and 14*c* in a position facing the window 73 of portion 14*b*. Magnetically actuated switches (such as Hall effect transducers and circuitry for processing the electrical output thereof) for sensing patterns of holes (or magnetically permeable inserts) in magnetic programming cards to be described below, and one or more light-emitting diodes (e.g., LEDs 72 shown in FIG. 23 or single LED 72 shown in FIG. 28) can be mounted on board 70. These components will be discussed below in greater detail. Alternatively, the components are all connected to a single circuit board 68 (in which case, board 70 is omitted).

Stepper motor 74 and cam gear cluster 55 are also mounted within assembled elements 14*a*, 14*b*, and 14*c*. Two cams 50 and one cam gear 54 are fixedly mounted on cam shaft 52. Shaft 52 is rotatably mounted to element 14*a* by cam bearings 51. Thus, cams 50, gear 54, and shaft 52 rotate together as a unit. Gear cluster 55, engaged between motor 74 and cam gear 54, is driven by motor 74 (which is preferably an electronically controlled electric step motor).

In a preferred embodiment, the microprocessor is preprogrammed to assert any of two or more sets of control signals to motor 74. For example, the microprocessor can be programmed to assert a first set of relatively low current signals to the motor in the event that the batteries powering the apparatus have a low level (or if the onboard sensors indicate that the apparatus is stuck against an obstacle), and otherwise to assert a second set of relatively high current signals to the motor. The currents of the "relatively low" current signals can be selected to maximize the torque exerted by the motor while minimizing battery consumption, and the currents of the "relatively high" current signals can be selected to maximize the torque exerted by the motor (without a battery consumption minimization constraint). Thus, the motor can be controlled to consume less power in response to the "relatively low" current signals than in response to the "relatively high" current'signals.

Each of cams 50 defines a cam track 50*a* (best shown in FIG. 5) having a non-uniform radius relative to shaft 52. In variations on this embodiment, cams 50 are replaced by cams 50′ shown in FIG. 10A or cams such as the cam having camtrack 50A′ shown in FIGS. 9 and 10. Each of cams 50′ defines at least one cam track 50*b* having a non-uniform radius relative to central portion 52*a* of cam 50′ (cams 50′ are mounted to shaft 52 by inserting shaft 52 through portion 52*a* of each cam 50′). A pair of cam follower links 151 (one of which is shown in FIG. 7A and in FIG. 7B) are provided, each having a cam follower shaft 150 which rides in one of the cam tracks 50a or 50b. Or, a pair of cam follower links 151' (one shown in each of FIGS. 9 and 10) are provided, each having a cam follower shaft 150' which rides in one of tracks 50A'. In order to shift the rotation of wheel 21 (or wheel 23) between forward (F) and reverse (R) rotational directions, shaft 150' is forced vertically downward by the rotation cam into a position in which shaft 150' encounters a large radius segment of track, or shaft 150' is forced vertically upward by the rotating cam into a position in which shaft 150' encounters a small radius segment of track 50A'. To disengage wheel 21 or 23 from the means for driving it, shaft 150' is forced by the rotating cam into a position in when shaft 150' encounters a segment of track 50A' having an intermediate radius.

Figure 7B:
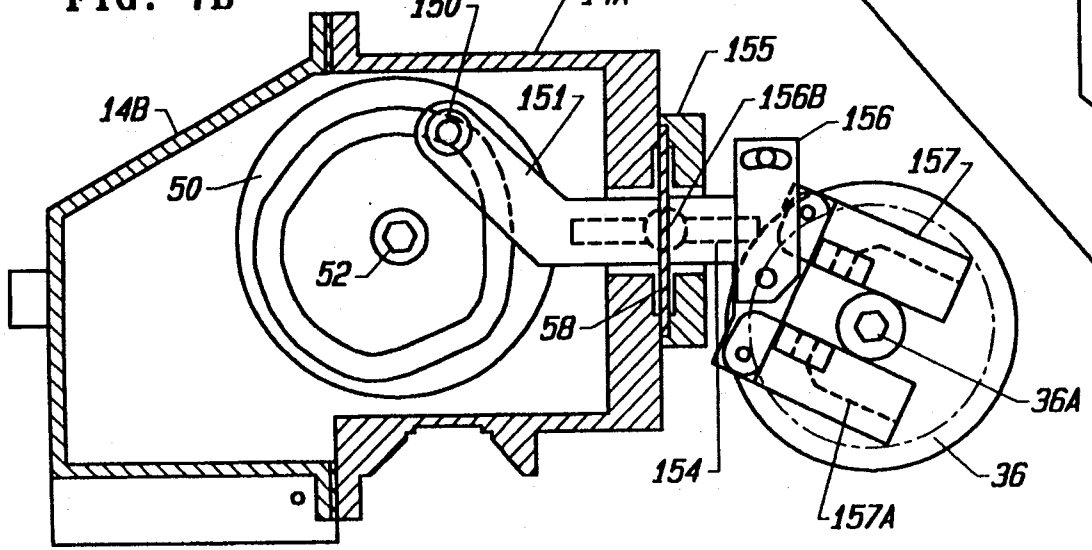
FIG. 7B is a side cross-sectional view of the control box and cam-driven shifting mechanism of the FIG. 1 apparatus.

Also mounted within the sealed control box assembly is a stiffening tube 154 for each link 151. Each tube 154 is fitted within hole 153 at the flat end 152 of link 151 (as indicated by FIGS. 7A and 7B). Each flat end 152 abuts a diaphragm seal 58 mounted over an opening 15 in portion 14a, with tube 154 extending through a central orifice in diaphragm 58 into a shift link 156. Each link 156 is mounted on the other side of diaphragm 58 (outside the control box assembly) and has a flat end 156b (shown in FIG. 7B) which fits against end 152 of the corresponding link 151, with diaphragm 58 pressed tightly (by seal plate 155) between ends 152 and 156b (to prevent liquid leakage into the control box assembly).

A seal plate 155 (shown in FIGS. 7A and 7B) is fixedly attached to each of the left and right faces 155a (shown in FIG. 7) of control box portion 14a. A shift link 156 fits within an opening through the center of each seal plate 155. As cam 50 pivots link 151 upward (or downward), link 156 at the opposite end of the rigid shift assembly (comprising link 151, tube 154, and link 156) will pivot downward (or upward).

As shown in FIGS. 7A and 7B, a fork 157 is pivotally attached to each link 156. Each fork 157 has a shoulder 157a (shown in FIG. 7B) which engages an end portion 35a of a control arm 35 (shown in FIG. 7A). Pivoting control arm 35 engages bearing 37 on axle 36a connected to ring gear 36. To move the left ring gear 36 upward into engagement with the left idler gear 34 (into the position shown in FIG. 11), the left shift assembly comprising link 151, tube 154, link 156, and fork 157 pivots upward, thus moving gear 36 upward (while pivoting left control arm 35 relative to housing member 39a). Similarly, to move the right ring gear 36 upward into engagement with the right idler gear 34 (into the position shown in FIG. 11), the right shift assembly comprising link 151, tube 154, link 156, and fork 157 pivots upward, thus moving gear 36 upward (while pivoting right control arm 35 relative to housing member 39b).

FIGS. 9 and 10 are simplified diagrams representing "up" and "down" positions, respectively, of ring gear 36. As shown in FIG. 9, shaft 150 is forced downward by cam track 50a as it engages a segment of cam track 50a having a large radius relative to cam shaft 52 (a "large radius segment" of track 50a). In this case, fork 157 translates ring gear 36 into an upper position (corresponding to the position shown in FIG. 11). In FIG. 10, shaft 150 is forced upward by cam track 50a as it engages a segment of cam track 50a having a small radius relative to cam shaft 52 (a "small radius segment" of track 50a). In this case, fork 157 translates ring gear 36 into its lower position (corresponding to the position shown in FIG. 12).

With reference again to FIG. 7, cam tracks 50a have identical shapes, but the two cams 50 are assembled essentially "back-to-back" (one is rotated by 180 degrees about the vertical axis in FIG. 7 relative to the other), which orients the cam track 50a of one of them as the mirror image of cam track 50a of the other (so that the angular orientation of one track 50a about shaft 52 is displaced relative to the orientation of the other track 50a about shaft 52). Similarly, in the FIG. 10A embodiment, two identical cams 50' are assembled essentially "back-to-back" on shaft 52, thus orienting cam track 50b of one of them as the mirror image of cam track 50b of the other. With cams 50 (or 50') so oriented, rotation of gear 54 (and hence shaft 52) through a full (360 degree) revolution causes cams 50 (or 50') to rotate through six (in the FIG. 7 embodiment) or eight (in the FIG. 10A embodiment) distinct position pairs relative to left and right shafts 150.

With reference to FIG. 7, in the first such position pair, the left shaft 150 is in an "up" position (riding on a small radius segment of the left track 50a) and the right shaft 150 is also in an "up" position (riding on a small radius segment of the right track 50a). In the second position pair, the left shaft 150 is in an "up" position (riding on a small radius segment of the left track 50a) and the right shaft 150 is in a neutral position (riding on an intermediate radius segment of the right track 50a). In the third position pair, the left shaft 150 is in an "up" position (engaged with a small radius segment of the left track 50a) while the right shaft 150 is in a "down" position (engaged with a large radius segment of the right track 50a). In the fourth position pair, the left shaft 150 is in a neutral position (riding on an intermediate radius segment of the left track 50a) while the right shaft 150 is in a neutral position (riding on an intermediate radius segment of the right track 50a). In the next (fifth) position pair, the left shaft 150 is in a "down" position (riding on a large radius segment of the left track 50a) while the right shaft 150 is in an "up" position (riding on a small radius segment of the right track 50a). In the sixth position pair, the left shaft 150 is in a neutral position (riding on an intermediate radius segment of the left track 50a) and the right shaft 150 is in an "up" position (riding on a small radius segment of the right track 50a).

With pair of cams 50 in the first through sixth positions, left and right link assemblies (each comprising a link 151, a tube 154, a shift link 156, a fork 157, a control arm 35, and a ring gear 36) cause left wheel 23 and right wheel 21 to rotate in the directions shown in Table 1:

TABLE 1

| cam pair position | left wheel direction | right wheel direction |
|---|---|---|
| first | forward | forward |
| second | forward | neutral |
| third | forward | reverse |
| fourth | neutral | neutral |
| fifth | reverse | forward |
| sixth | neutral | forward. |

Thus, the apparatus will rotate toward the right with the cam pair in its second position, sharply to the right with the cam pair in the third position, toward the left with the cam pair in the sixth position, and sharply to the left with the cam pair in the fifth position.

Figure 10A:
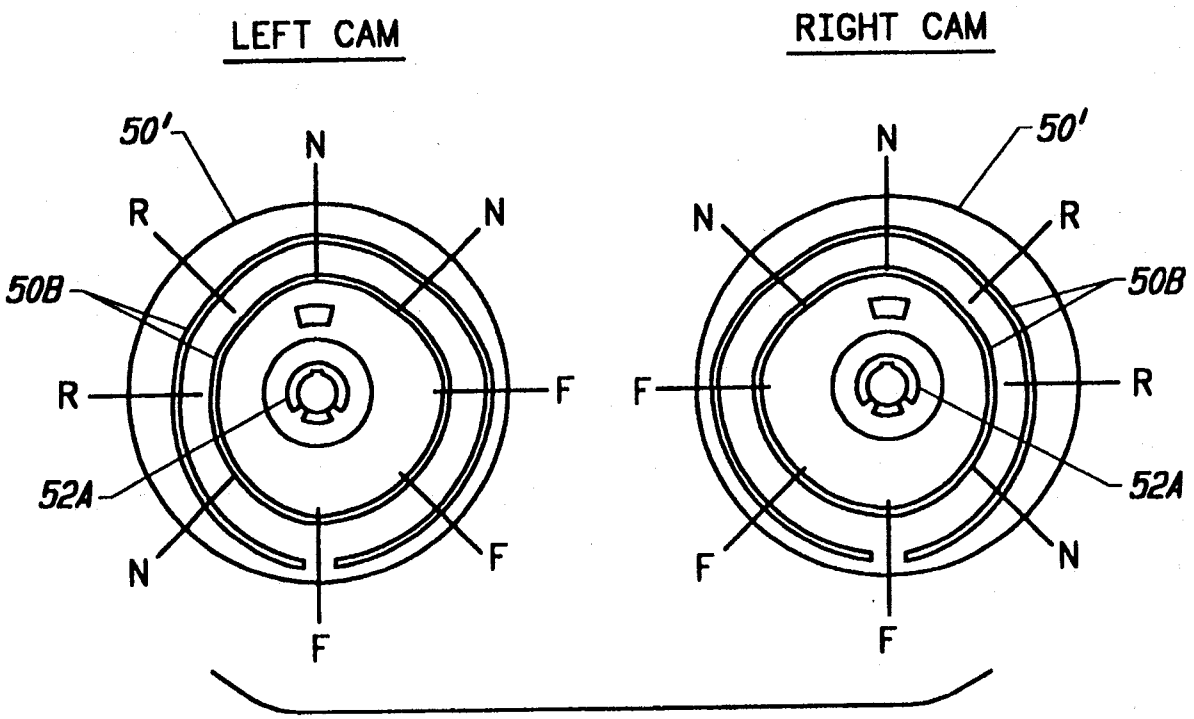
FIG. 10A is a diagram of two cams that are on a shaft in an embodiment of the invention.

We next describe the FIG. 10A embodiment, in which cams 50' have eight distinct position pairs relative to left and right shafts 150. With reference to FIG. 10A, if a cam follower (at the end of each of left and right shafts 150) rides in the lowest portion of each cam track 50*b* (i.e., in the six o'clock position) with cams 50' in a "first" position as shown, the left shaft 150 is in a "down" position (riding on a large radius segment of the left track 50*b*) and the right shaft 150 is also in a "down" position (riding on a large radius segment of the right track 50*b*).

In the second position pair (with cams 50' rotated clockwise by forty-five degrees from their positions shown in FIG. 10A), the left shaft 150 is in a "down" position (riding on a large radius segment of the left track 50*b*) and the right shaft 150 is in a neutral position (riding on an intermediate radius segment of the right track 50*b*). In the third position pair (with cams 50' rotated clockwise by ninety degrees from their positions shown in FIG. 10A), the left shaft 150 is in a "down" position (engaged with a large radius segment of the left track 50*b*) while the right shaft 150 is in an "up" position (engaged with a small radius segment of the right track 50*b*). In the fourth position pair, the left shaft 150 is in a neutral position (riding on an intermediate radius segment of the left track 50*b*) while the right shaft 150 is in an "up" position (engaged with a small radius segment of the right track 50*b*). In the fifth position pair, the left shaft 150 is in a neutral position (riding on an intermediate radius segment of the left track 50*b*), while the right shaft 150 also is in a neutral position (riding on an intermediate radius segment of the right track 50*b*). In the sixth position pair, the left shaft 150 is in an "up" position (riding on a small radius segment of the left track 50*b*) while the right shaft 150 is in a neutral position (riding on an intermediate radius segment of the right track 50*b*). In the seventh position pair, the left shaft 150 is in an "up" position (riding on a small radius segment of the left track 50*b*), while the right shaft 150 is in a "down" position riding on a large segment of the right track 50*b*). In the eighth position pair (with cams 50' rotated counter-clockwise by forty-five degrees from their positions shown in FIG. 10A), the left shaft 150 is in a neutral position (riding on an intermediate radius segment of the left track 50*b*) and the right shaft 150 is in a "down" position (riding on a large radius segment of the right track 50*b*).

With pair of cams 50 in the first through eighth positions, left and right link assemblies (each comprising a link 151, a tube 154, a shift link 156, a fork 157, a control arm 35, and a ring gear 36) cause left wheel 23 and right wheel 21 to rotate in the directions shown in Table 1A:

TABLE 1A

| cam pair position | left wheel direction | right wheel direction |
|---|---|---|
| first | forward | forward |
| second | forward | neutral |
| third | forward | reverse |
| fourth | neutral | reverse |
| fifth | neutral | neutral |
| sixth | reverse | neutral |
| seventh | reverse | forward |
| eighth | neutral | forward. |

Thus, the apparatus will rotate toward the right with the cam pair in its second position, sharply to the right with the cam pair in the third position, toward the right in a reverse turn with the cam pair in the fourth position, toward the left in a reverse turn with the cam pair in the sixth position, sharply to the left with the cam pair in the seventh position, and toward the left with the cam pair in the eighth position.

With reference again to FIG. 7, battery 62 is sealed within housing portion 14*a* by O-ring 64 and battery cap 66 (which screws into threaded recess 14*e* of portion 14*a*). Battery 62 supplies power to the circuitry of boards 68 and 70, to motor 74, and optionally also to sensors employed in the inventive apparatus. In a preferred variation, battery 62 is not employed (so that components 64 and 66 and recess 14*e* shown in FIG. 7 can also be omitted). Instead a self-contained, watertight battery pack unit 62' is employed, which includes a set of batteries (for example, six batteries 63', one of which is shown in phantom view in FIG. 7). The latter embodiment includes means for providing a watertight connection (i.e., seal 64') between batteries 63' and circuit board 68 mounted within control box assembly 14 for supplying power from the batteries to all the power-consuming components of the inventive apparatus (including microprocessor 68*b* and motor 74). Batteries 63' can be rechargeable or non-rechargeable.

To illustrate, battery pack 62' could be kept watertight with "feed through" metal connectors molded into the plastic housing of battery pack 62' providing electrical continuity between the batteries 63' and battery pack plug 65' located outside housing. Watertight control box assembly 14 preferably also has "feed through" metal connectors molded into a wall of portion 14*b* thereof, to provide electrical continuity between circuit board 68 within assembly 14 and an outside receptacle (on the outer side of portion 14*b*) for mating with battery pack plug 65'. Molding the connectors in place provides a watertight seal.

Battery pack plug 65' with its metal connectors is inserted into the control box receptacle (not shown) with its connectors. The connectors make contact and electrical continuity is achieved between batteries 63' and circuitry on circuit board 68. In order to prevent corrosion of the metal connectors, a watertight seal 64' is inserted around plug 65' between pack 62' and the outer receptacle which mates with plug 65'.

Next, one embodiment of the onboard sensors and programmable control means of the invention will be discussed with reference to FIGS. 3, 13, and 18–23.

In an embodiment, the invention includes a steering cam position sensor (shown in FIGS. 3 and 13) comprising magnet disc 47 fixedly attached to cam rod 52 (for rotation as a unit with rod 52), one or more magnets 47*b* mounted around the periphery of disc 47, and a Hall detector unit 47*a* fixedly mounted in a position for detecting the proximity of each magnet 47*b* which rotates past unit 47*a*. The output of Hall detector unit 47*a* is a data stream which is processed in microprocessor 68*b*. In variations on this embodiment, disc 47 is omitted, magnets 47*b* mounted around the periphery of one of cams 50, and Hall detector unit 47*a* positioned to detect the proximity of the magnets 47*b* mounted on the cam. In other variations, the magnets and Hall transducers are replaced, respectively, by radiation emitting units (such as LEDs) and radiation detectors (such as photodetectors). For example, a slotted disc can be fixedly attached to rotating cam rod 52, an infrared emitting diode mounted on one side of the disc, and an infrared photodetector mounted on the other side of the disc in a position for detecting infrared radiation transmitted from the diode through the slots of the disc (as the disc rotates past the diode and photodetector).

The FIG. 13 embodiment of the invention includes a turbine pressure sensor assembly comprising pressure lines 100 and 101 (also referred to as "tubes" 100 and 101), differential pressure sensors 106 and 108, and switches 107 and 109. Line 100 is coupled to turbine assembly 12, so the pressure of fluid (i.e., air) within line 100 represents the fluid pressure Pt within the turbine assembly at turbine assembly outlet 10. The outer end of line 101 terminates at an elastic diaphragm 101*a*, which is exposed to the exterior of control box assembly 14. The pressure of fluid (i.e., air) within line 101 will depend on the depth of diaphragm 101*a* in the body of water (or other liquid) in which the inventive apparatus is immersed, and represents a reference fluid pressure $P_o$.

Each of differential pressure sensors 106 and 108 generates an output signal indicative of the difference in pressure $(P_t - P_o)$ between lines 100 and 101. Sensor 106 is set to generate a "switch" signal to cause switch 107 to open (or close), when the pressure difference decreases below a first negative quantity, $-A$. When the pressure difference rises to a value greater than quantity, $-A$, sensor 106 generates a second switch signal causing switch 107 to enter its other state (closed or open).

Similarly, sensor 108 is set to generate a switch signal to cause switch 109 to open (or close), when the pressure difference decreases below a second negative quantity, $-B$. When the pressure difference rises to a value greater than quantity, $-B$, sensor 108 generates a second switch signal causing switch 109 to enter its other state (closed or open).

For example, when pressure difference $(P_t - P_o)$ is at a maximum (i.e., equal to zero), which indicates that the surface pump is off or the surface filter is full (so that no water is flowing upward through outlet 10 to the surface), both switches 107 and 109 will typically be open. Then, if the pressure difference falls to a value $-V$ in the range $-B < -V - A$ (upon normal operation of the inventive apparatus, with impeller 40 rotating in response to flowing water within turbine assembly 12), sensor 106 will cause switch 107 to close (but switch 109 will remain open). Then, if the pressure difference falls to a value $-U$, where $-U < -B < -V$ (which can occur if inlet 9 becomes jammed with debris), sensor 107 will cause switch 109 to close (so that both switches 107 and 109 will be closed).

Figure 22:
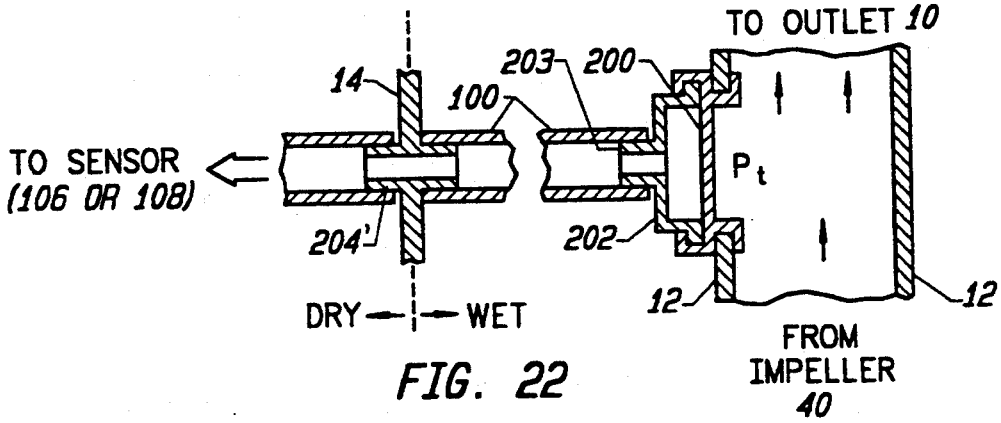
FIG. 22 is a cross-sectional view of a portion of an alternative embodiment of the turbine pressure sensor assembly of the invention.

A preferred apparatus for connecting line 100 to turbine assembly 12 and control box assembly 14 (which houses sensors 106 and 108) will be described with reference to FIG. 22. As shown in FIG. 22, elastic diaphragm seal 200 fits in an orifice in the sidewall of turbine assembly 12. Plastic mounting member 202 is fitted to seal 200. One end of tube 100 is fitted onto hollow nozzle 203 of mounting member 202. Thus, seal 200 prevents liquid from escaping from within turbine assembly 12 into tube 100 (which is filled with another fluid, which can be gas such as air, or liquid). In addition to performing this sealing function, seal 100 deforms in response to changes in pressure in the liquid within assembly 12, thereby causing corresponding pressure changes in the fluid within tube 100. Because members 200 and 202 are exposed to the wet environment outside sealed control box assembly 14, and sensors are mounted in the dry environment inside assembly 14, the sidewall of assembly 14 (i.e., the sidewall of one of control box portions 14*a* and 14*b*) has a double nozzle fitting 204 which defines (and surrounds) an orifice through the sidewall. An outer length of tube 100 fits tightly around one nozzle of bulkhead connector member 204', and an inner length of tube 100 fits tightly around the other nozzle of member 204', to provide fluid communication between the inner and outer lengths of tube 100 while preserving control box assembly 14's fluid seal.

With reference again to FIG. 13, bulkhead connectors 204' are employed to pass both tubes 100 and 101 through the sidewall of assembly 14. As also shown in FIG. 13, T-shaped breach sensor tube 102 has right and left branches, which terminate, respectively, at open tube ends 102*a* and 102*b* at the front of the inventive apparatus. Water (or other liquid) in which the inventive apparatus is immersed is sucked into tube ends 102*a* and 102*b*, through orifice 204 connected along tube 102, and then through branch tube 102*c* into the interior of turbine assembly 12. The pressure, $P_b$, of the fluid flowing through narrow orifice 204 will undergo a change upon breach of one or both of tube ends 102*a* and 102*b* from the immersing liquid. Such pressure change is detected at differential pressure sensor 110, to which narrow orifice 204 is connected by a portion of line, 102.

Reference pressure tube 111 is connected between the portion of tube 101 within control box assembly 14 and sensor 110, so that the pressure within tube 111 is equal to the reference fluid pressure $P_o$ in tube 101. Differential pressure sensor 110 will generate an output signal indicative of the difference in pressure $(P_b - P_o)$ between lines 102 and 111. Sensor 110 is set to generate a "switch" signal for causing switch 113 to open (or close), when the pressure difference decreases below a selected negative quantity $(-C)$. When the pressure difference rises to a value greater than quantity $-C$, sensor 110 generates a second switch signal causing switch 113 to enter its other state (closed or open).

Processor 68*b* interprets the status of switches 107, 109, and 113 as being indicative of any of a variety of operating conditions (e.g., the occurrence of a breach, or a jam blocking inlet 9 of turbine assembly 12).

In alternative embodiments, the invention does not include any of elements 100–102, 102*c*, 106–111, 113, 204, and 204' shown in FIG. 13.

Figure 13A:
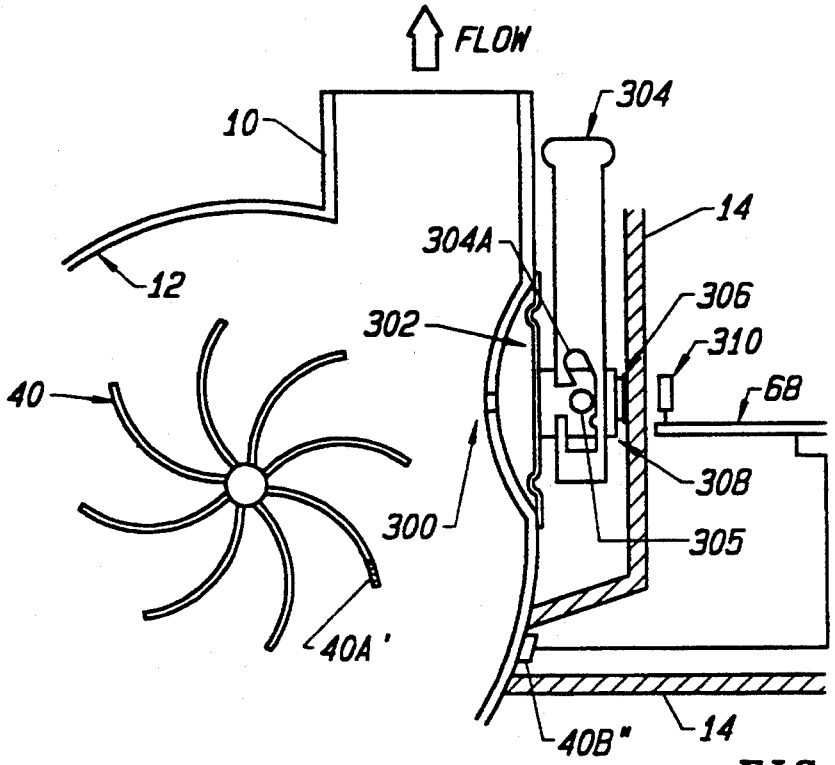
FIG. 13A is a side cross-sectional view of a portion of a preferred substitute for the automatic power switch of the FIG. 13 apparatus.

A substitute for the turbine pressure sensor assembly comprising pressure lines 100 and 101, differential pressure sensors 106 and 108, and switches 107 and 109, will next be described with reference to the preferred embodiment shown in FIG. 13A. In this preferred embodiment, port 300 extends through a side wall of turbine assembly 12, and elastic vacuum diaphragm 302 separates turbine port 300 from ambient pressure and movable switch bar 304. A permanent magnet 306 is fixedly attached to magnet mount 308 outside the side wall of control box assembly 14, and mount 308 is fixedly attached to diaphragm 302. Magnetically actuated switch 310 (which can be a reed switch) is mounted in the dry environment within the interior of assembly 14, and is electrically connected to processor 68*b* (or interface electronics connected to processor 68*b*) on printed circuit board 68.

Switch bar 304 can be manually operated to command the apparatus to enter any of multiple pre-programmed operating modes (such as "Momentary On," "Automatic," and "Lock Off" modes). This is accomplished by moving magnet 306 relative to magnetically actuated switch 310, thereby causing switch 310 to assert corresponding control signals to power supply circuit 63 (shown in FIG. 23).

For example, when bar 304 is pushed downward into its "down" position (and held in the "down" position) in which surface 304*a* of bar 304 rests against guide pin 305, magnet 306 translates away from switch 310. In response, switch 310 generates a control signal for activating power supply circuit 63. Also in response, onboard microprocessor 68*b* can initiate a Momentary On mode, in which microprocessor 68*b* activates selected components of the apparatus for test purposes, regardless of whether hose connection 10 of assembly 12 is connected to a suction means. Bar 304 is preferably biased (such as by a spring) so that when the user then releases bar 304 from the down position, bar 304 will relax back from the down position to the "middle" position (shown in FIG. 13A) in response to which reed switch 310 sends a control signal to power supply circuit 63 and microprocessor 68*b* initiates an "Automatic" mode.

In the Automatic mode, power supply circuit 63 and microprocessor 68*b* respond as follows to the pressure level within assembly 12. When there is low pressure within assembly 12 (e.g., when water is being sucked from inlet 9 out through hose connection 10) or a predetermined period of time after the pressure within assembly 12 drops below a trigger level, diaphragm 302 will flex inward toward vacuum port 300, thereby pulling magnet 306 away from switch 310. In response, switch 310 will assert a control signal activating power supply circuit 63, causing power to be supplied to elements of the apparatus from which power had been disconnected (to "wake up" the apparatus) and/or to cause the apparatus to execute a "default" cleaning mode. When a preprogrammed period of time has elapsed after the apparatus wakes up (or power supply 63 has been activated), microprocessor 68*b* asserts a control signal (i.e., signal PWROFF indicated in FIG. 23) to deactivate power supply circuit 63, and/or to cause the apparatus to enter a "sleep" mode in which the transmission shifts to a neutral gear and suspends most operations (so that it consumes low power to avoid unnecessary battery consumption). If, during the Automatic mode, the pressure within assembly 12 rises to a sufficient level (e.g., when water ceases to flow rapidly, or to flow at all, from inlet 9 out through hose connection 10), diaphragm 302 will flex outward away from vacuum port 300, thereby moving magnet 308 toward switch 310. In response, switch 310 will assert a control signal deactivating power supply circuit 63 to shut down the apparatus.

If the user manually pulls bar 304 upward (from the "down" or "middle" position) into the "up" position in which surface 304*b* of bar 304 rests against stop 305, switch 310 will respond by asserting a control signal to circuit 63, with the result that microprocessor 68*b* will initiate a "Lock Off" mode in which all assemblies of the apparatus are locked into an "off" or deactivated state.

Figure 24:
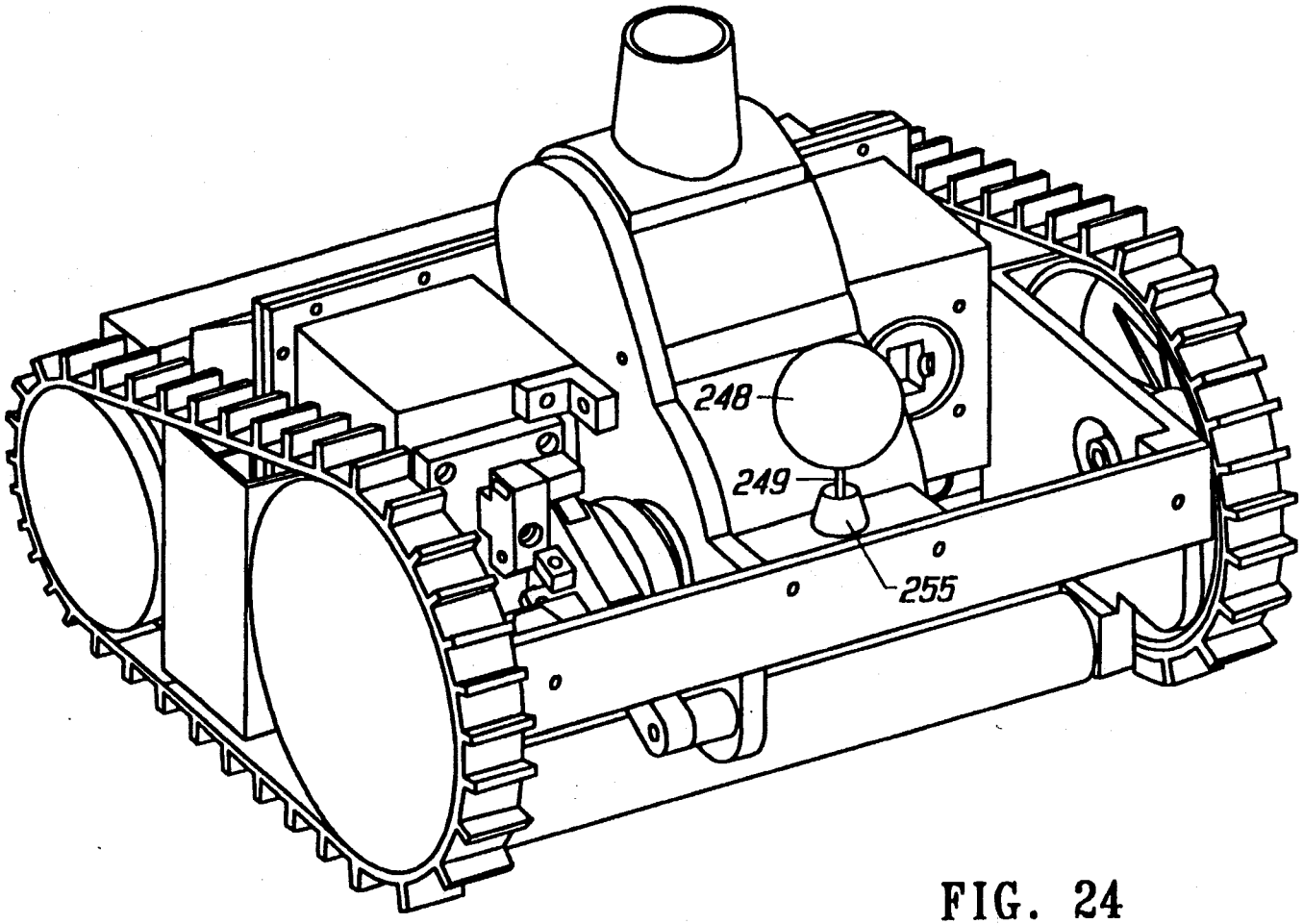
FIG. 24 is a front perspective view of a second alternative embodiment of the inventive apparatus.
Figure 25:
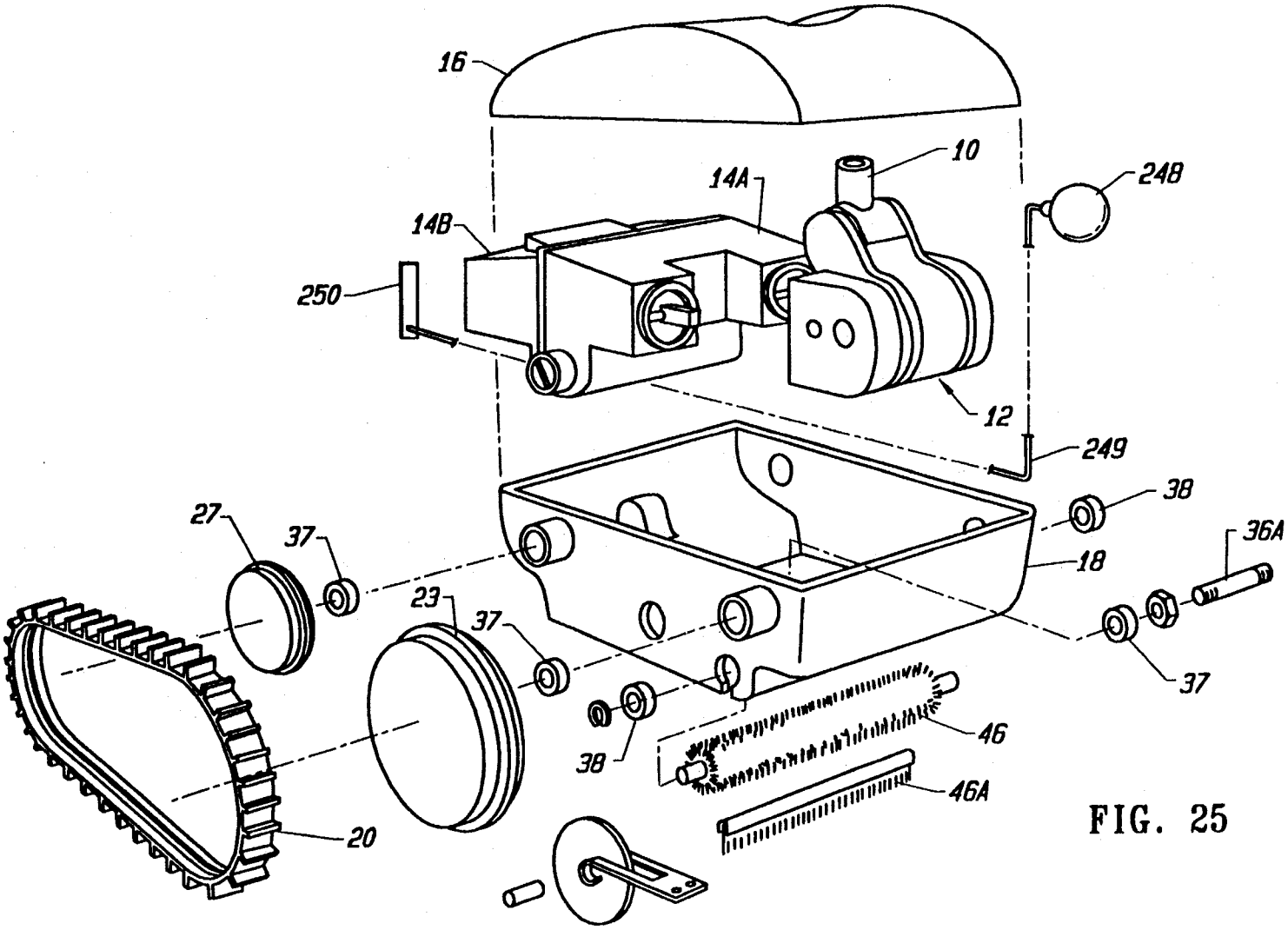
FIG. 25 is an exploded perspective view of a portion of the main subassemblies of the FIG. 24 apparatus.

Other preferred embodiments of the invention employ breach sensors other than the breach sensor assembly shown in FIG. 13. For example, FIGS. 24, 25, and 26 show a preferred breach sensor assembly which comprises float 248, cable 249, magnetically permeable bar 250, magnetically actuated switch 251, magnetically permeable bar 252, permanent magnet 253, and mount 254. Elements 248, 249, 250, and 254 are disposed in the wet environment outside control box wall 14*b*, and the other elements are disposed in the dry environment inside the control box assembly. Bar 252 allows lines of magnetic flux to extend from magnet 253 to switch 251, and magnet 253 is preferably positioned in direct contact with magnetically permeable wall 14*b*. In variations on the embodiment shown, float 248 can be replaced by a non-spherical float having a streamlined design for reducing hydrodynamic drag as the inventive apparatus translates through a body of water.

Mount 254 fixedly connects a first end of bar 250 (which is preferably made of metal) to the outside of control box portion 14*b* so that bar 250 is free to bend relative to mount 254 in response to force exerted (on the other end of bar 250) by cable 249. When the inventive apparatus is immersed in liquid, float 248 exerts a buoyant force on cable 249 which causes cable 249 to displace bar 250 away from control box portion 14*b* (into the "immersed" position shown in phantom view in FIG. 26). When the inventive apparatus (in particular, float rest 255) breaches the surface of the liquid, float 248 ceases to exert a buoyant force on cable 249, so that bar 250 is free to relax back into contact with control box portion 14*b* (into the position identified by reference numeral 250' in FIG. 26). When bar 250 occupies its "breach" position (position 250'), cable 249 retracts float 248 into the breach position identified by reference numeral 248' in FIG. 26.

Magnetically actuated switch 251 generates a different output signal in the case that bar 250 is in the breach position (position 250') than it does when bar 250 is in its normal "immersed" position, due to the different magnetic fields to which switch 251 is exposed in these two cases. The output of switch 251 is a digital data stream which is processed in processor 68*b*.

Figure 26A:
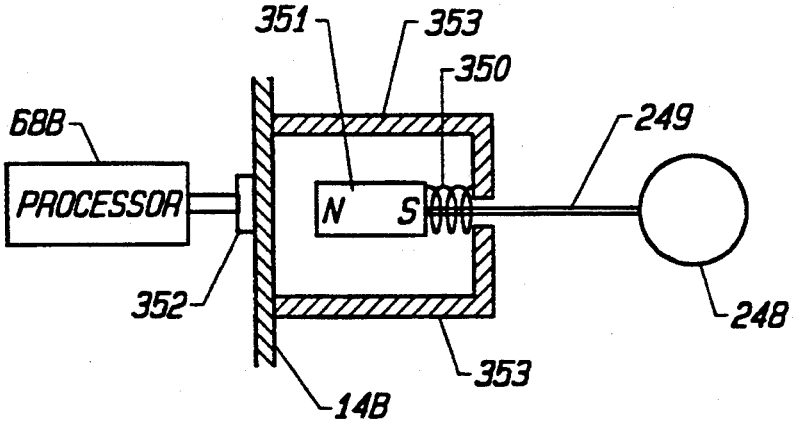
FIG. 26A is a schematic diagram of an alternative breach sensor which can be employed as a substitute for that shown in FIG. 26.
Figure 26:
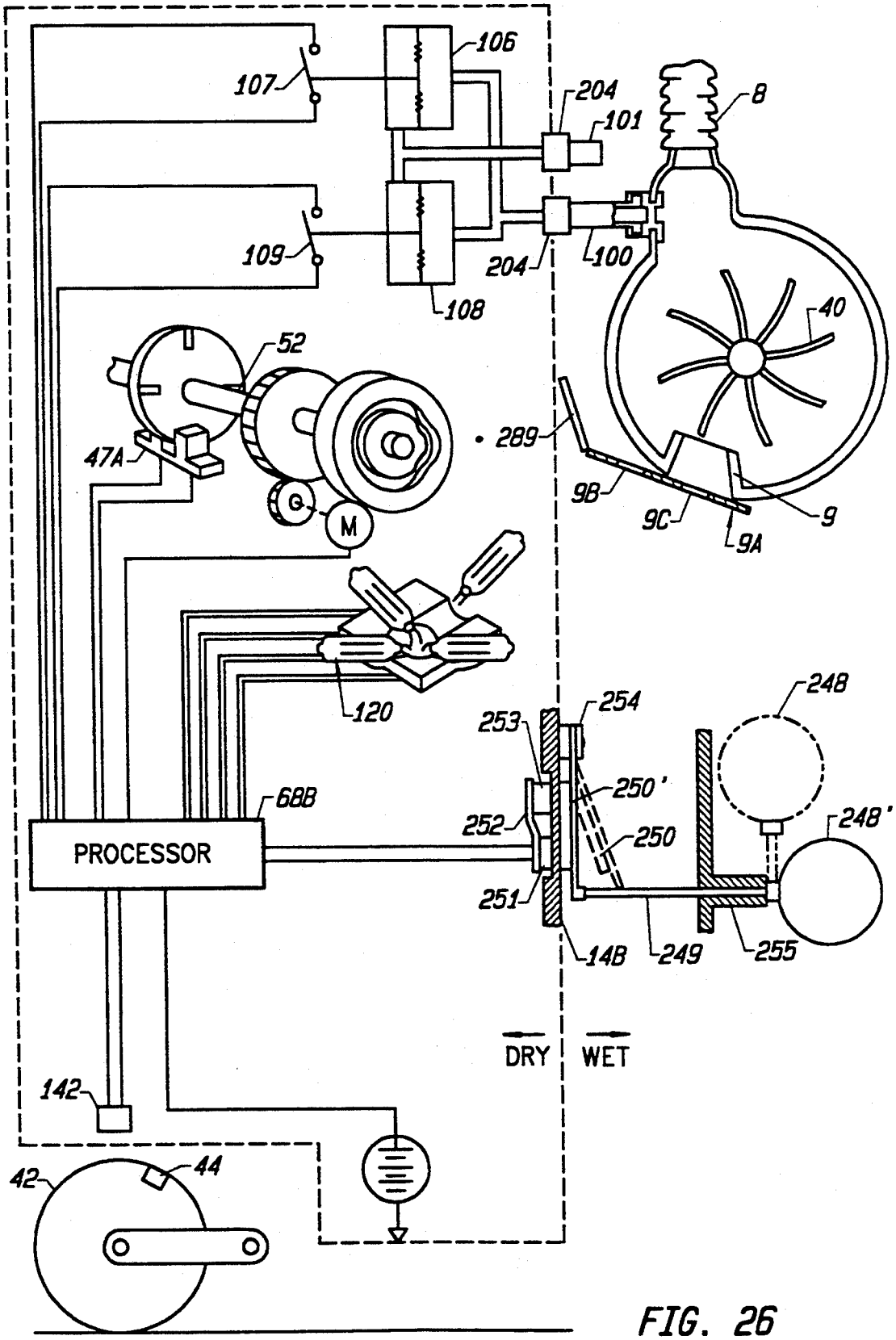
FIG. 26 is a schematic diagram representing sensors employed in the FIG. 24 apparatus, and an interface circuit and processor for processing output signals produced by the sensors.

In breach sensor shown in FIG. 26A, elements 250–254 are eliminated, and replaced by permanent magnet 351, spring 350, magnet housing 353 (fixedly attached to the wall of control box portion 14*b*), and reed switch 352 (electrically connected to processor 68*b*). In FIG. 26A, float 248 normally exerts a buoyant force on cable 249 which causes cable 249 to pull magnet 351 to the right, thus compressing spring 350 between magnet 351 and housing 353. In this position, reed switch 352 (within control box portion 14*b*) asserts a first signal to processor 68*b*. Then, when the inventive apparatus breaches the surface of the liquid, float 248 ceases to exert a buoyant force on cable 249, so that spring 350 pushes magnet 351 to the left, toward reed switch 352. In response, switch 352 asserts a second signal to processor 68*b* (to indicate a breach condition).

Next, a preferred turbine speed sensor assembly will be described with reference to FIG. 13. This assembly includes permanent magnet 40*a'* fixedly mounted on rotatable impeller 40 and magnetic transducer 40*b'* (which can be a Hall effect transducer) fixedly mounted within turbine assembly 12 and electrically connected to processor 68*b* within control box assembly 14.

As impeller 40 rotates, transducer 40*b'* will assert one output pulse per each revolution of magnet 40*a'* relative to transducer 40*b'*. These pulses are supplied (typically through an analog-to-digital conversion circuit) as a data stream to microprocessor 68*b*, and are employed by microprocessor 68*b* as timing pulses to increment software-implemented operations. For example, microprocessor 68*b* can be programmed to cause the apparatus to execute X operations (consisting of Y cycles of Z repeating operations) and then to initiate a sleep mode, where Y is a preprogrammed number of revolutions of turbine impeller 40.

As a substitute for turbine speed transducer 40b' of FIG. 13, a turbine speed transducer can be mounted in the dry environment within control box assembly 14 in a position for detecting the proximity of magnet 40a'. Turbine speed transducer 40b'' shown in FIG. 13A, which is a magnetic transducer mounted within control box assembly 14, is an alternative turbine speed transducer of this type. In the FIG. 13A embodiment, the portion of the wall of turbine assembly 12 to which transducer 40b'' is mounted should have good magnetic permeability. The electrical output of transducer 40b'' (a signal indicative of turbine speed) is supplied to circuitry on circuit board 68.

In an alternative preferred embodiment, transducer 40b' is fixedly mounted in the dry environment within control box assembly 14 in a position sufficiently close to impeller 40 so that transducer 40b' will assert a pulse each time magnet 40a' rotates past transducer 40b'.

Next, tilt sensor 120 Will be described with reference to FIG. 13. Tilt sensor 120 includes four mercury switches 120a, 120b, 120c, and 120d, and injection molded frame 121. Frame 121 is mounted in the dry environment inside the control box assembly, in such an orientation that the mercury switches are aligned with the principal axes of the inventive apparatus (the forward/reverse and left/right axes). Frame 121 is shaped to constrain each of switches 120a–120d at a tilt angle selected to cause contact closure when the inventive apparatus tilts by a sufficient angle about a principal axis. The output of each of switches 120a, 120b, 120c, 120d is supplied as a digital data stream (indicative of positive and negative pitch, and left/right roll of the inventive apparatus) to microprocessor 68b for processing. Microprocessor 68b can employ the tilt sensor output signals for purposes which include the following: to sense that the apparatus is climbing a wall (in response to which the microprocessor can modify the current operating mode of the apparatus); and to distinguish between "true" motion signals from the motion sensor (e.g., transducer 142) asserted while the apparatus is not excessively tilted, and "false" motion signals from the motion sensor (e.g., transducer 142) asserted while the apparatus is stuck against an obstacle (and is rocking back and forth against the obstacle) in an excessively tilted orientation.

Figure 2:
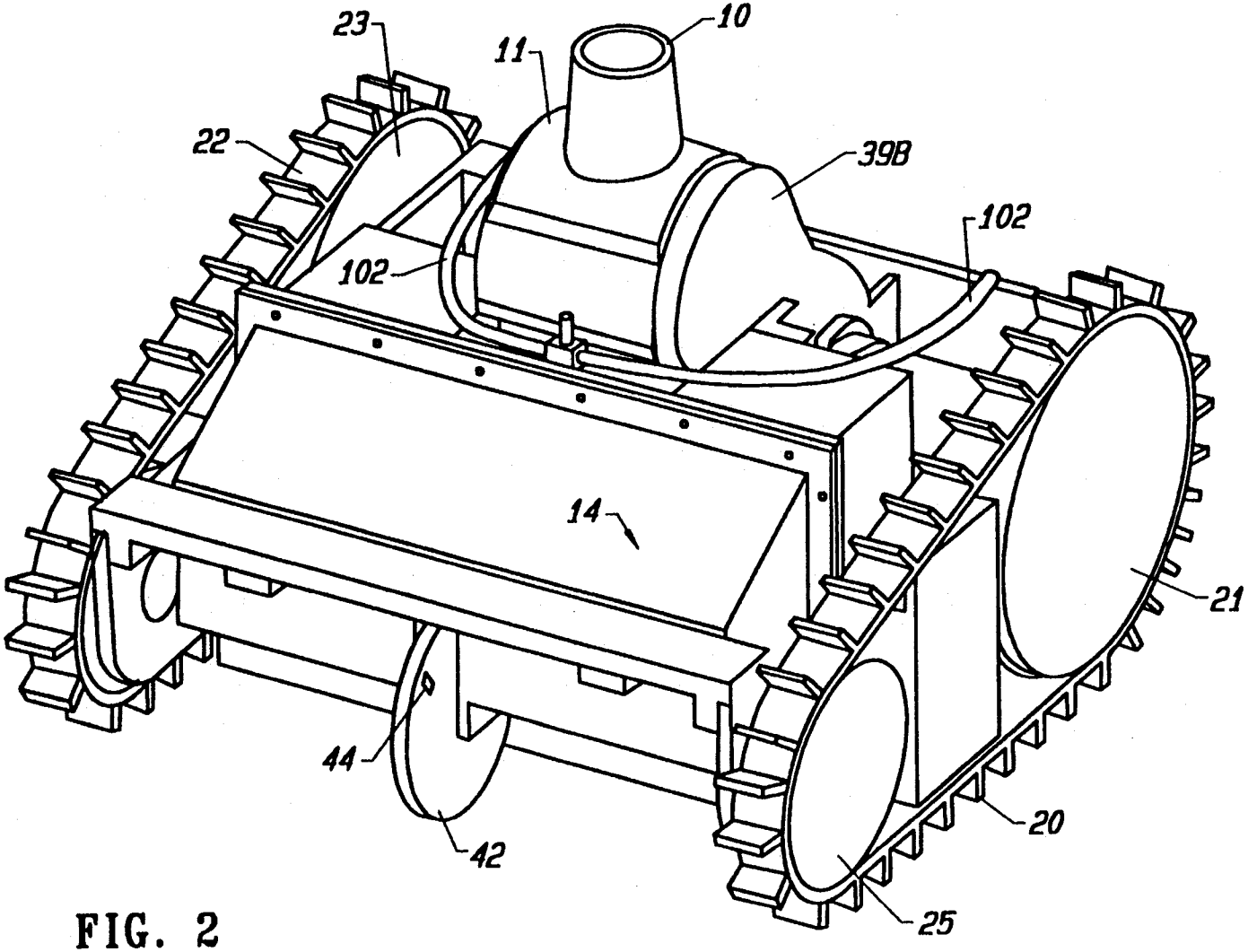
FIG. 2 is a rear perspective view of the FIG. 1 apparatus.

An embodiment of the motion sensor of the invention will next be described with reference to FIGS. 2, 3, and 13. In this embodiment, wheel 42, having one or more permanent magnets 44 mounted around its rim, is rotatably mounted at the rear of the inventive apparatus. Although FIGS. 2 and 3 show wheel 42 mounted substantially midway between left and right treads 20 and 22, wheel 42 can be mounted in other positions (such as at the left or right side of the apparatus). For example, in the preferred embodiment discussed below with reference to FIG. 28, wheel 42' (which performs the same function as wheel 42 of FIG. 2) is rotatably mounted at the right side of the inventive apparatus substantially midway between the front and rear of the apparatus. By positioning wheel 42' near the side wheels (wheels 21' and 25' in FIG. 28) improved contact is achieved between the outer rim of wheel 42' and the surface to be cleaned by the apparatus.

With reference to FIGS. 3 and 13, Hall effect transducer 142 is mounted in the dry environment inside the control box assembly, in a position near the rim of wheel 42 (or wheel 42' in the FIG. 28 embodiment). Hall effect transducer 142 detects the proximity of each magnet 44 (or magnet 44' in the FIG. 28 embodiment) which rotates past it. The output of Hall effect transducer 142 is supplied as a digital data stream to microprocessor 68b for processing. Microprocessor 68b can generate control signals in response thereto indicating whether the apparatus is moving or stationary. Alternative embodiments include no such motion sensing means.

Next, we describe (with reference to FIGS. 7 and 18–21) two embodiments of a means for commanding microprocessor 68b to execute selected pre-programmed operating modes (e.g., to rotate shaft 52, and hence pair of cams 50, through desired sequences of the above-described cam position pairs).

Figure 18:
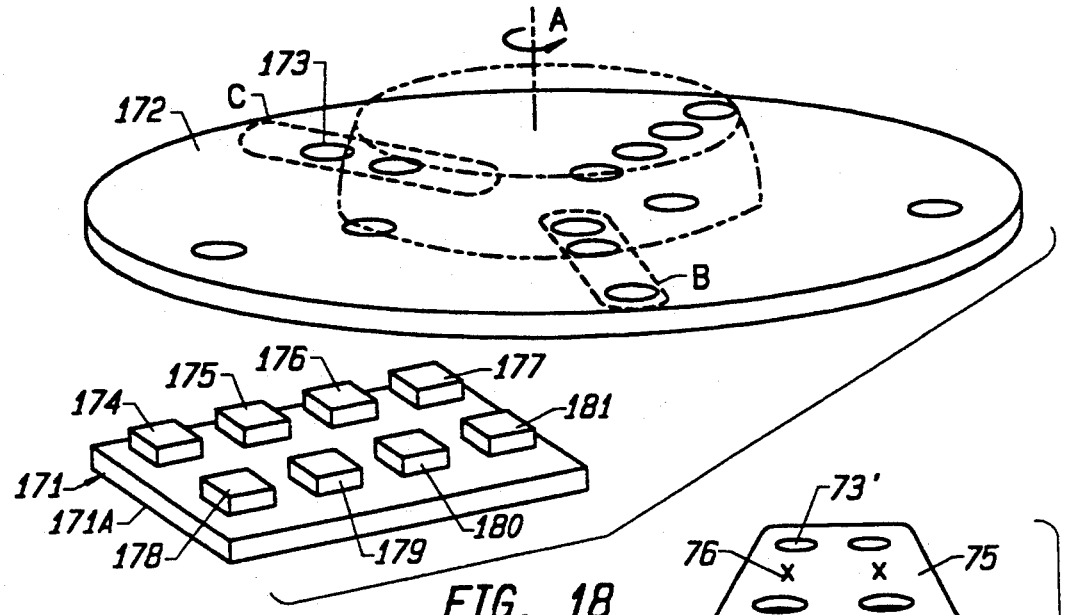
FIG. 18 is a perspective view of a first embodiment of components of the inventive apparatus which select one of multiple pre-programmed modes of operation.

With reference first to FIGS. 7 and 18, array 171 of Hall effect transducers is mounted in the dry environment within control box assembly 14. Magnetic programming card 172 is rotatably mounted adjacent Hall, effect transducer array 171. For example, card 172 can be mounted within the control box assembly, and means (not shown) can be provided for rotating card 172 into a desired angular orientation relative to sensor set 171. Such means for rotating card 172 can be as simple as a knob which extends from card 172 through the sidewall of the control box assembly (enabling a user to grip, and manually rotate, the knob to rotate the card). If card 172 is mounted within the control box assembly in a position facing window 73, the rotational orientation of card 172 can be viewed through the window (if the window is transparent) while card 172 is rotated. Alternatively, card 172 can be rotatably mounted in the wet environment outside the control box assembly in a position facing window 73 (in this case, window 73 need not be transparent).

Card 172 is composed of magnetically permeable material, and has a pattern of holes 173 punched through it. Holes 173 are arranged along radial lines (lines extending radially outward from axis A, card 172's axis of rotation). Hall effect transducer array 171 includes magnetically permeable plate 171a, permanent magnets 178, 179, 180, and 181 mounted on plate 171a (in alignment with a radial line of card 172), and Hall effect transducers 174, 175, 176, and 177 mounted on plate 171a (parallel to magnets 178–181).

To command microprocessor 68b to execute a particular preprogrammed program (for a particular time duration), card 172 is rotated until a desired row of holes 173 is aligned over fixed row of magnets 178–181. For example, card 172 can be rotated to align row B of holes over the magnets (so that each of magnets 178, 180, and 181 has a hole 173 over it), or card 172 can be rotated to align row C of holes over the magnets (so that each of magnets 179 and 180 has a hole 173 over it). Each hole pattern comprising a row of holes through card 172 represents coded information specifying a particular program (pre-programmed in microprocessor 68b), and optionally also a particular duration during which the specified program is to be executed.

Figure 19:
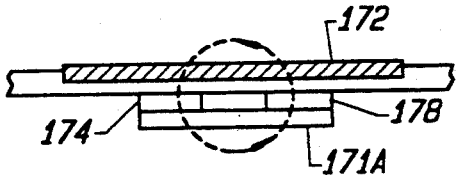
FIG. 19 is a side cross-sectional view of a portion of the FIG. 18 apparatus.

As indicated by FIG. 19, when no hole 173 is positioned over a magnet, a magnetic circuit is completed between that magnet (i.e., magnet 178 in FIG. 19) and the corresponding Hall effect transducer (i.e., transducer 174 in FIG. 19). In this case, the transducer asserts a first distinctive signal to processor 68b.

Figure 20:
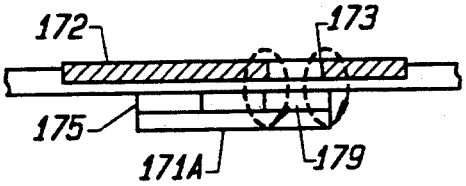
FIG. 20 is a side cross-sectional view of another portion of the FIG. 18 apparatus.

In contrast, when a hole 173 is positioned over a magnet, the hole alters the magnetic field adjacent the magnet (as indicated by dashed lines of magnetic flux adjacent magnet 179 in FIG. 20), so that a much lower magnetic field is present at the corresponding Hall effect transducer (i.e., transducer 175 in FIG. 19). In this case, the transducer asserts a second distinctive signal to processor 68*b*.

Microprocessor 68*b* interprets the first and second distinctive signals received from transducers 174–177 as a bit pattern (consisting of serial or parallel bits) commanding execution of a particular preprogrammed operating mode.

Figure 21B:
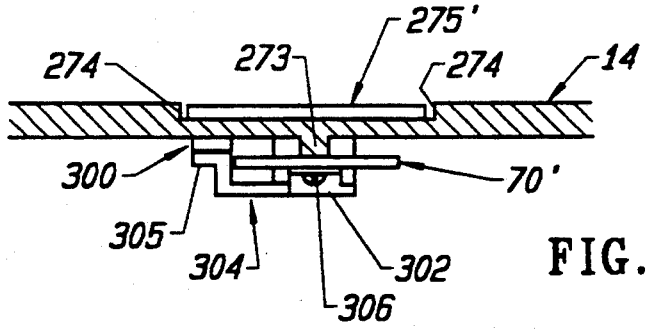
FIG. 21B is a side cross-sectional view of the FIG. 21A components, assembled together and mounted to a side wall of the control box assembly of the inventive apparatus.
Figure 21A:
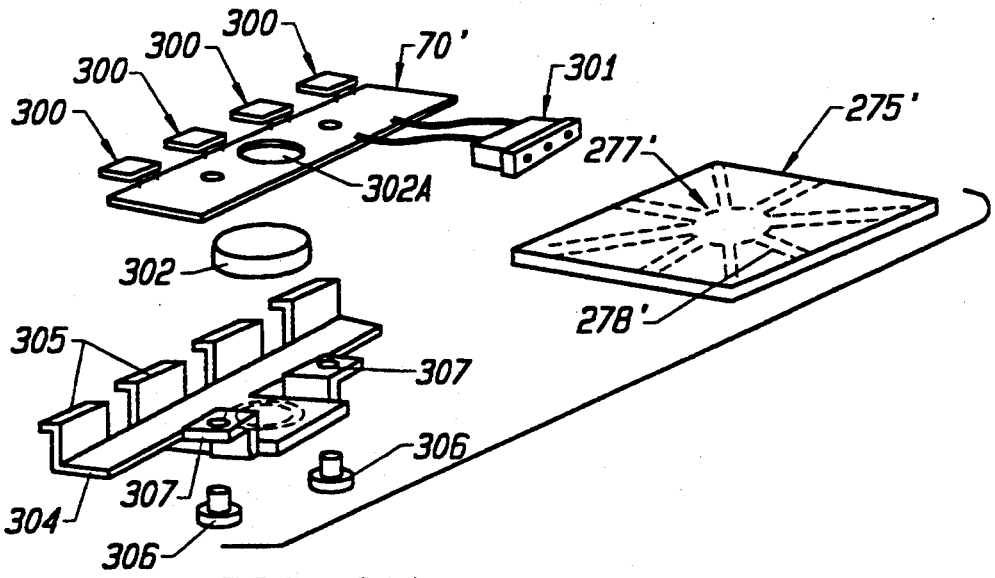
FIG. 21A is an exploded perspective view of a third (preferred) embodiment of components of the inventive apparatus which select one of multiple pre-programmed modes of operation.
Figure 14:
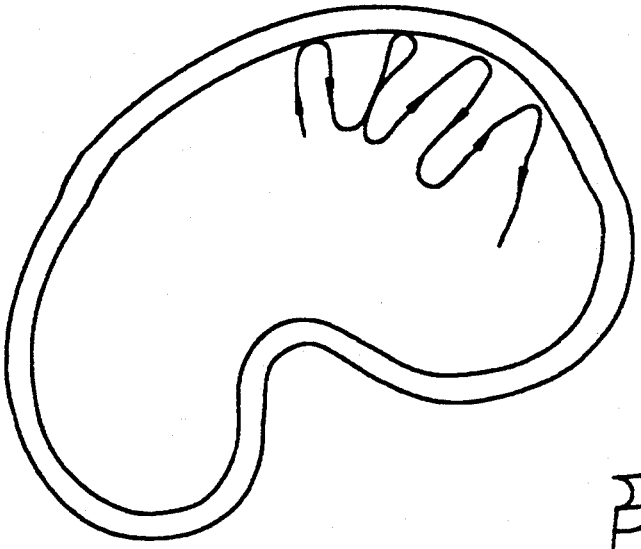
FIG. 14 is a schematic diagram representing a swimming pool, and a serpentine path on the pool bottom along which the inventive apparatus can travel in one of its operating modes.
Figure 21:
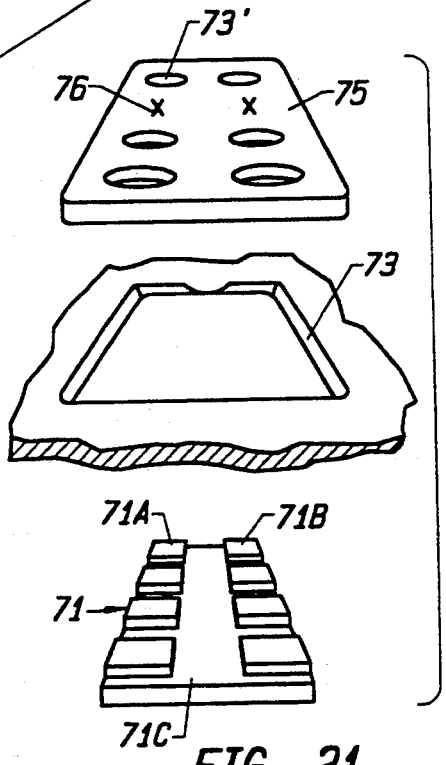
FIG. 21 is a perspective view of a second embodiment of components of the inventive apparatus which select one of multiple pre-programmed modes of operation.

In an alternative embodiment to be described with, reference to FIGS. 7 and 21, Hall effect transducer array 71 is mounted in the dry environment within control box assembly 14 in a position facing recessed, thin window 73 in the control box sidewall. Magnetic card 75 is shaped for insertion in the recess defined by window 73. Card 75 is composed of magnetically permeable material, with a pattern of holes 73' punched through it. Holes 73' are arranged along two parallel rows on card 75 (with the absence of a hole indicated by reference numeral 76 in FIG. 21).

Hall effect transducer array 71 includes magnetically permeable plate 71*c*, four permanent magnets 71*a* mounted on plate 71*c* (in alignment with one of the hole rows of card 75), and Hall effect transducers 71*b* mounted on plate 71*c* (in alignment with the other hole row of card 75).

As in the FIG. 18 embodiment, each of transducers 71*b* will assert an output signal indicative of the presence or absence of a hole 73' above it (and above the adjacent magnet 71*a*). Transducers 71*b* will assert these output signals to microprocessor 68*b*, which will interpret them as a pattern of "zero" and "one" bits commanding execution of a particular one of multiple preprogrammed operating mode (optionally, the bit pattern also specifies a time duration for executing the specified operating mode).

To command microprocessor 68*b* to execute a different one of the several programs preprogrammed therein, a first card 75 is removed from window 73, and a second card 75 (having a different pattern of holes 73') is inserted in window 73 in place of the first card. Microprocessor 68*b* will interpret the resulting new (and different) bit pattern as a command for execution of a different one of the preprogrammed operating modes.

FIG. 21A is a perspective view of a third (preferred) embodiment of the components of the inventive apparatus which select one of multiple pre-programmed modes of operation. FIG. 21B shows the FIG. 21A components after they have been assembled together and mounted to a side wall of control box assembly 14. As indicated in FIG. 21B, Hall effect transducers 300 are mounted in the dry environment within control box assembly 14 in a position facing a recessed, thin portion of box 14's side wall between shoulders 274 (one shoulder 274 is shown in below-described FIG. 28). Programming card 275' is shaped for insertion in the recess between shoulders 274.

Card 275' is composed of a square of magnetically permeable material with an insert 277' molded within it, as shown in FIG. 21A. Insert 277' (which is preferably made of steel) has a different magnetic permeability than the surrounding portion of card 275' and includes a set of fingers 278' which extend radially outward from the card center to its edges. For example, insert 277' can be a specially shaped stamped sheet steel insert molded within plastic. When card 275' is positioned between shoulders 274 (of the type shown in FIG. 29) close to Hall effect transducers 300 (mounted within the sealed walls of control box assembly 14 as shown in FIG. 21B), the presence or absence of a portion (e.g., a finger 278') of insert 277' near each transducer 300 causes each transducer 300 to assert a control bit signal to a microprocessor electrically connected to the transducer within control box assembly 14, each of which control bit signals is typically interpreted by the microprocessor as a binary zero or one. The control bit signals simultaneously asserted by all transducers 300 collectively command the microprocessor to execute one of several pre-programmed programs (or branches of programs), and thus to operate in one of several corresponding predefined modes. For example, control bit signals asserted by transducers 300 can command the microprocessor to execute escape maneuvers, to clean the bottom only of a swimming pool (or perform any of a number of other selectable cleaning programs), to turn the apparatus off or on (independent of pump cycles), or to control the duration of a particular cleaning cycle.

Hall effect transducers 300 are electrically connected to circuitry on printed circuit board 70'. An electrical connector 301 is electrically connected to board 70'. Connector 301 is adapted to be plugged into main printed circuit board 68 (of the type shown in FIGS. 7 and 23), so that signals from transducers 300 can be converted to a bit pattern by circuitry on one or both of boards 70' and 68, and the bit pattern then supplied to microprocessor 68*b* mounted on board 68. In an alternative preferred embodiment, transducers 300 are mounted directly on printed circuit board 68, and board 70' and connector 301 are omitted.

Permanent magnet 302 is mounted between magnetically permeable plate 304 and board 70' (in magnetic contact with plate 304 and in alignment with hole 302*a* extending through board 70'). Four magnetic pole pieces 305 extend from plate 304. When screws 306 connect board 70' between flanges 307 of plate 304 and portion 273 of box 14's side wall (as shown in FIG. 21B), each of the four pole pieces 305 is aligned with one of Hall effect transducers 300. With the components assembled as shown in FIG. 21B, each of transducers 300 will assert an output signal indicative of the presence or absence of a portion (e.g., finger 278') of insert 277' adjacent to it, for the following reason. Finger 278' (or other portion of insert 277') has relatively high magnetic permeability, and will thus complete a magnetic circuit between magnet 302, member 304, one of members 305, the transducer 300 in contact with said one of members 305, and the magnetically permeable thin wall of control box 14. Completion of this magnetic circuit increases the magnetic field at the transducer 300 (above the level it would have if finger 278' (or other portion of insert 277' having relatively high magnetic permeability) were replaced by a portion having relatively low magnetic permeability.

Figure 21C:
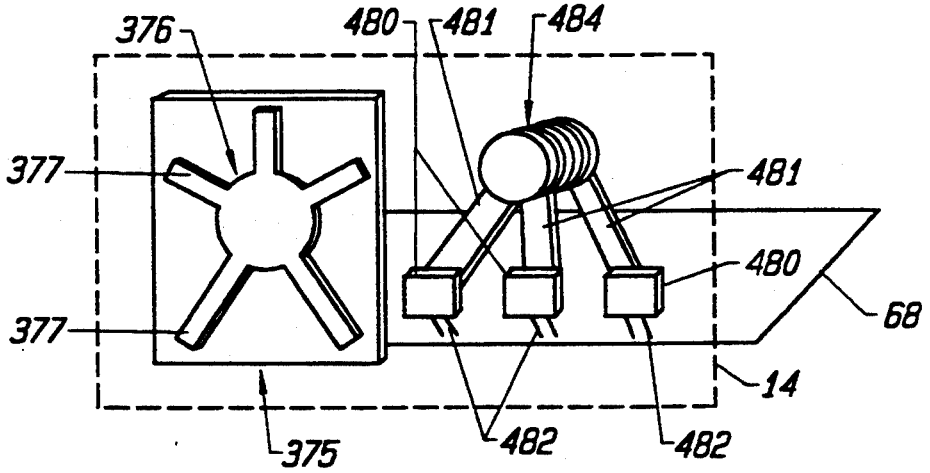
FIG. 21C is a perspective view of a fourth (preferred) embodiment of the inventive apparatus for selecting one of multiple pre-programmed modes of operation.

FIG. 21C shows a preferred variation on the apparatus of FIGS. 21A and 21B. In FIG. 21C, card 375 is a square of material having relatively low magnetically permeability with an insert 376 (having relatively high magnetic permeability) molded within it. Insert 376 (which is preferably made of steel) includes a set of fingers 377 which extend radially outward from the card center to its edges. When card 375 is positioned against a card-reading location of a wall of control box assembly 14, with its lower edge aligned with magnetic transducers 480 (mounted within the sealed walls of control box assembly 14), the presence or absence of a finger 377 near each transducer 480 causes each transducer 480 to assert a control bit signal through electrical conductor 482 and other conductors (not shown) on circuit board 68 to a microprocessor (connected to circuit board 68) within control box assembly 14.

Each of such control bit signals is typically interpreted by the microprocessor as a binary zero or one. The control bit signals simultaneously asserted by all transducers 480 collectively command the microprocessor to execute one of several pre-programmed programs (or branches of programs), and thus to operate in one of several corresponding predefined modes.

As shown in FIG. 21C, permanent magnet 484 is connected by a highly magnetically permeable member 481 to each of transducers 480. Each of transducers 480 will assert an output signal indicative of the presence or absence of a finger 377 adjacent to it, for the following reason. Because finger 377 has relatively high magnetic permeability, it completes a magnetic circuit between magnet 484, one of members 481, the transducer 480 connected to said one of members 481, and the magnetically permeable wall of control box 14 between the transducer 480 and the finger 377. Completion of this magnetic circuit increases the magnetic field at the transducer 480 (above the level it would have if finger 377 were replaced by a card portion having relatively low magnetic permeability.

Of course, card 375 can be oriented with any of its four edges in alignment with row of transducers 480, and with either of its square faces facing transducers 480. Thus, by shaping insert 376 to present a different pattern of finger ends to transducers 480 in each of such eight orientations, a single card 375 can be used to cause transducers 480 to command the microprocessor to execute any desired one of eight pre-programmed programs (or program branches).

Figure 21D:
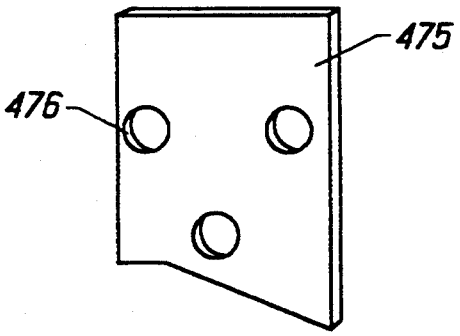
FIG. 21D is a perspective view of a programming card which can be used as a substitute for card 375 shown in FIG. 21C.

Card 475 shown in FIG. 21D can be used as a substitute for card 375 of FIG. 21C. Card 475 has the same outer dimensions as card 375, but it consists of highly magnetically permeable material whose periphery has a pattern of holes 476 punched therethrough. If the lower edge of card 475 is aligned with transducers 480 of FIG. 21C, the middle transducer will output a "zero" bit signal (indicating that no magnetic circuit containing that transducer has been completed), and the two outer transducers will output a "one" bit signal (each indicating that a magnetic circuit containing said transducer has been completed). In contrast, if the upper edge of card 475 is aligned with transducers 480 of FIG. 21C, each of the three transducers 480 will output a "one" bit signal (indicating that a magnetic circuit containing each of the three transducers 480 has been completed). Alternatively, the locations of holes 476 can be filled by material (e.g., plastic) of lower magnetic permeability than the rest of card 475.

An example of an operating mode which can be programmed using the inventive programming card is a serpentine (perimeter-cleaning) mode, in which the apparatus follows a path (such as that shown in FIG. 14) along a wall. In such a mode, the apparatus automatically executes a rotation (e.g., a slightly less than 180 degree clockwise rotation, or more typically, a 90 degree clockwise rotation) upon encountering a non-horizontal submerged surface (such as the vertically inclining sidewall of a swimming pool), then executes forward translation for a predetermined time after such a turn, and then executes another rotation in the same direction (e.g., a slightly less than 180 degree clockwise rotation) at the end of the timed forward translation. Preferably, the apparatus is programmed using a magnetic programming card (of the type described with reference to FIGS. 18, 21, or 21B) to select a predetermined forward translation time (and/or number of turns) having duration suitable for the size of the surface to be cleaned. Relatively long program times can be programmed for large swimming pools, and relatively short times can be programmed for small swimming pools.

In variations on the perimeter-cleaning mode, the processor of the inventive apparatus monitors the tilt sensors and executes a rotation upon occurrence of any of a variety of tilt conditions. Some such variations will allow wall climbing; others will prevent wall climbing.

Figure 15:
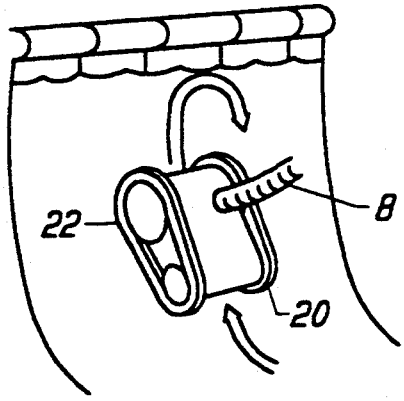
FIG. 15 is a perspective view of the inventive apparatus climbing a sidewall of a swimming pool.
Figure 16:
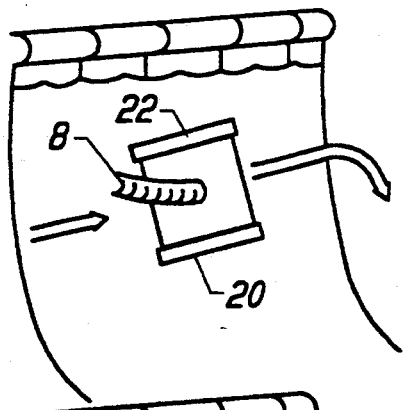
FIG. 16 is a perspective view of the inventive apparatus translating generally horizontally along a sidewall of a swimming pool.
Figure 17:
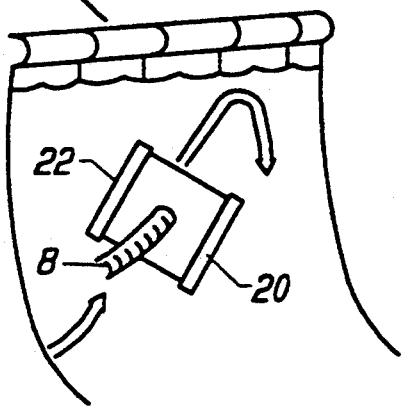
FIG. 17 is a perspective view of the inventive apparatus translating along a sidewall of a swimming pool.

In a perimeter-cleaning mode to be described with reference to FIGS. 15–17, the apparatus executes one of three different turns, depending on the angle at which it is incident at a non-vertical surface. The apparatus automatically executes a U-turn (in the direction indicated by the arrow in FIG. 15) upon "straight-on" incidence at a non-horizontal surface after translation on a horizontal surface. Specifically, the apparatus executes such a U-turn when its tilt sensors indicate an "up" tilt (about the left-right axis of the apparatus) but no "left" or "right" tilt (about the forward-reverse axis of the apparatus). The apparatus can also be programmed to execute such a U-turn upon breaching the surface of the water which immerses the surface being cleaned, if the onboard tilt sensors indicate no "left" or "right" tilt.

The apparatus automatically executes a 90-degree turn (i.e., in the direction indicated by the arrow in FIG. 16) upon glancing incidence at a non-horizontal surface after translation on a horizontal surface. Specifically, the apparatus executes a 90-degree right turn when its tilt sensors indicate no "up" tilt but a "right" tilt (a clockwise tilt about the forward-reverse axis), and a 90-degree left turn when its tilt sensors indicate no "up" tilt but a "left" tilt (a counterclockwise tilt about the forward-reverse axis).

The apparatus automatically executes a 135-degree turn (i.e., in the direction indicated by the arrow in FIG. 17) upon "intermediate" incidence at a non-horizontal surface after translation on a horizontal surface. Specifically, the apparatus executes a 135-degree right turn when its tilt sensors indicate an "up" tilt and also a "right" tilt (a clockwise tilt about the forward-reverse axis), and a 135-degree left turn when its tilt sensors indicate an "up" tilt and also a "left" tilt (a counterclockwise tilt about the forward-reverse axis).

The apparatus can be programmed to perform a variety of patterns in which it cleans only horizontal surfaces (i.e., swimming pool floors). For example, the apparatus can automatically execute a 180 degree (or less than 180 degree) turn when its tilt sensors indicate that it has reached a non-horizontal surface, and can then translate in a substantially forward direction until its tilt sensors again indicate that the apparatus has reached a non-horizontal surface.

Another example of an operating mode which can be programmed using the inventive programming means is a horizontal surface cleaning mode, in which the apparatus translates along a spiral path of continuously decreasing radius, or executes a sequence of consecutive 90-degree turns all having the same (right or left) handedness (and in which the apparatus travels along straight paths of decreasing length between consecutive 90-degree turns.

A preferred embodiment of the electronic circuitry employed in the inventive apparatus will next be described with reference to FIG. 23.

Power supply circuitry 63 (which includes an embodiment of battery pack 62' comprising six D cells, producing a potential difference in the range from 3.75 to 9.5 volts) generates the following voltages: VMOVE (for use by motor control circuit 74*a*, including motor translator circuitry 74*b*, for controlling motor 74), 15 V (a regulated fifteen volt voltage for powering circuit elements, such as power switches, within power supply circuit 63), VCC (for powering circuit elements including microprocessor 68*b*), VBIAS (for use by motor translator circuitry 74*b* which outputs drive signals to motor 74), and VSENSE (for use by the sensor electronics of the inventive apparatus). Power supply circuit 63 generates voltages VMOVE, 15 V, VCC, VBIAS, and VSENSE in response to control signals from reed switch 310, as described above with reference to FIG. 13A.

Motor 74 (which drives gear cluster 55) is driven by motor control circuit 74*a*, and control circuit 74*a* operates in response to control signals (HIDRIVE, UD, UC, UB, and UA) asserted by microprocessor 68*b*. Within control circuit 74*a*, motor translator circuitry 74*b*, which preferably includes two H-bridge translator integrated circuits of the commercially available type known as 74C906 VQ1001, outputs drive signals directly to motor 74.

The output of digital transducer 40*b'* (shown in FIG. 13) is supplied to microprocessor 68*b* for processing. The output of Hall effect transducers 71*b* (in the FIG. 21 embodiment), 174–177 (in the FIG. 18 embodiment), or magnetic transducers 380 or 480 (in the FIG. 31 or 21C embodiments) is also supplied to microprocessor 68*b* for processing.

One or more light-emitting diodes (LEDs) 72 are provided for indicating particular operating conditions (for example, a jam condition detected by sensor 40*b'*). Microprocessor 68*b* generates LED control signals indicative of such conditions, and supplies such control signals to LED 72. In the preferred embodiment shown in FIG. 28, the apparatus includes a single LED 72, which is sufficiently bright to be visible to a person on the surface when the apparatus is submerged at its operating depth in a body of water. Preferably, LED 72 is a wide angle, highly efficient source of red light (with brightness in the range from 2.0–7.0 candela, at 20 mA), such as the SSL-LX100133XRC device available from Lumex Components Inc. LED 72 preferably radiates light out through a frosted lens, so as to greatly increase its viewing angle and viewability from the pool surface. Microprocessor 68*b* is programmed to cause this LED 72 to flash at a first rate (e.g., once per 3 seconds) when the apparatus is in a cleaning cycle, does not have a low battery, and is operating normally. When the apparatus is in a cleaning cycle but has a low battery condition, microprocessor 68*b* cause LED 72 to flash at a slower rate (e.g., to emit a 100 millisecond flash once per 15 seconds). Other operating conditions could, of course, be indicated by other LED flashing modes.

Optionally, the apparatus can display other visual indicators of operating status. For example, day-glow red and green panels can be selectively displayed through a transparent window (such as a transparent version of window 73 of FIG. 7) under direct, or indirect, control of microprocessor 68*b*. For example, in one embodiment, red and green panels are mechanically connected to each of right and left cams 50. When either one of the cams has been shifted into a "forward" gear position, the green panel connected thereto is visible through the window, when one of the cams has been shifted into a "neutral" gear position neither the red nor the green panel connected thereto is visible through the window, and when the apparatus has entered an abnormal operating condition, the red panel connected to one or both cams is visible through the window.

Figure 23A:
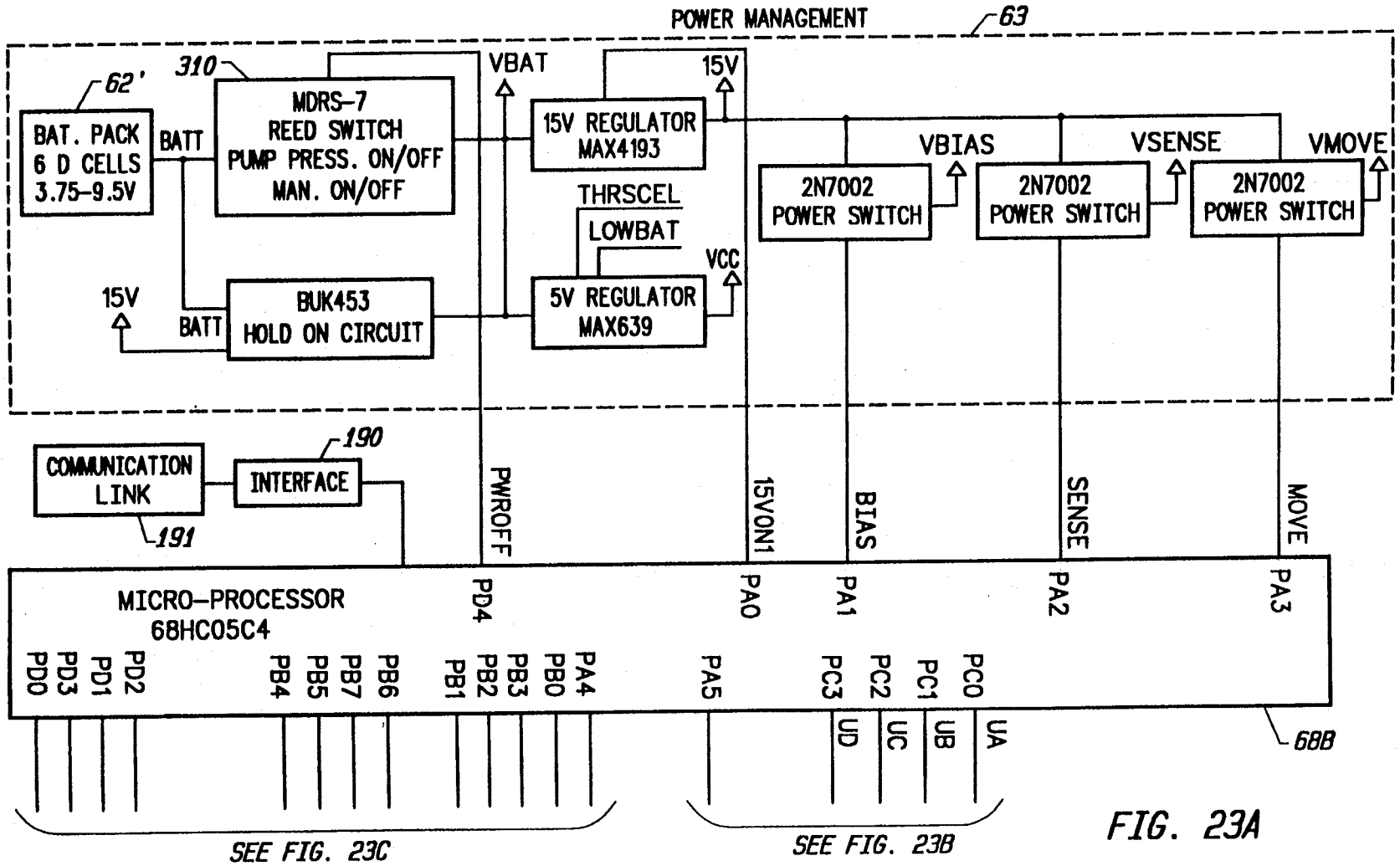
FIG. 23 is a block diagram of the electronic circuitry (including power supply circuitry) employed in a preferred embodiment of the invention.
Figure 23B:
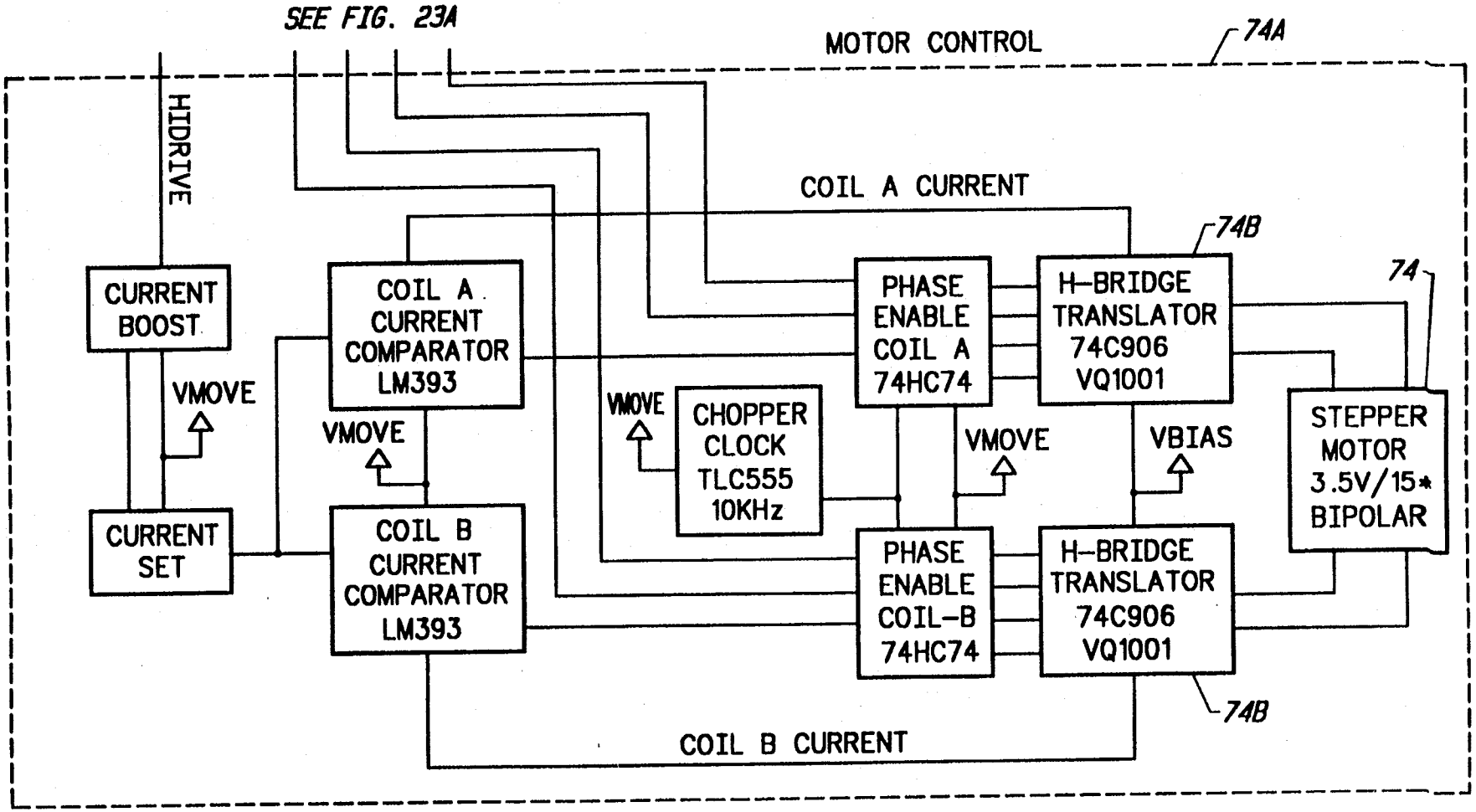
Figure 23C:
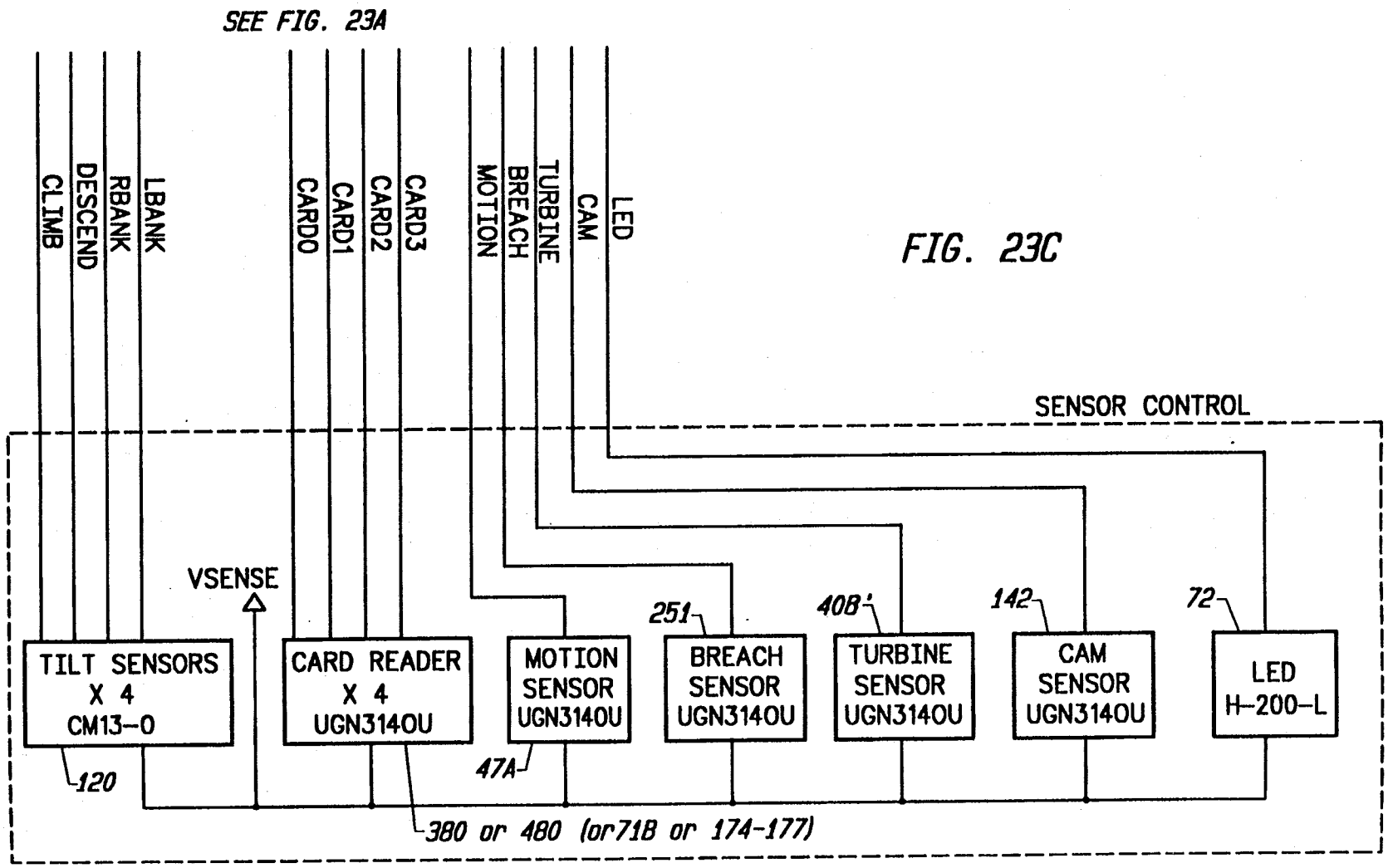

In variations on the FIG. 23 circuit, the output of all or some of switches 107, 109, and 113 (of the type shown in FIGS. 13 and 26) is supplied (optionally through an analog-to digital converter) to microprocessor 68*b* for processing.

In some embodiments, microprocessor 68*b* is programmed to assert a "Sleep" signal causing the apparatus to revert to a low-power consuming operating mode (in which circuit 63 of FIG. 23 is deactivated) automatically, after a predetermined time has elapsed following initiation of a cleaning operation (i.e., following insertion of a magnetic programming card, such as card 75 of FIG. 21, into a position facing magnetic transducers of the apparatus). In some embodiments, microprocessor 68*b* is programmed to automatically assert an "Awake" signal upon insertion of a magnetic programming card into a position facing magnetic transducers of the apparatus, thereby terminating "Sleep" status of the inventive apparatus (and activating circuit 63).

In some embodiments, a serial communication port 190 is connected to microprocessor 68*b*, to enable communication, via link 191, between microprocessor 68*b* and a remote computer at the surface. Link 191 (which can be a hardwired link, comprising a cable or wire, or a wireless communication link) provides an alternative means for programming and reprogramming microprocessor 68*b*, in addition to, or as a substitute for, insertion of a magnetic programming card into a position facing magnetic transducers of the apparatus. A suitable hardwired communication link can be incorporated into hose 8, extending between a surface computer and interface 190 in the control box assembly of the invention.

A preferred embodiment of the inventive apparatus is shown in FIGS. 27 and 28. This embodiment preferably includes mechanical linkages 279, 280, 281, and 289 to be described with reference to FIGS. 29, 30, and 26. The preferred embodiment of FIGS. 27 and 28 differs in the following respects from the above-described embodiments.

In the FIG. 27/28 embodiment, left and right front wheels 23' and 21' respectively, have slightly larger diameter than do left and right rear wheels 27' and 25' (unlike the FIG. 1 embodiment, for example, in which front wheels 21 and 23 have much larger diameter than do rear wheels 25 and 27). Also in the FIG. 27/28 embodiment, the left and right transmission assemblies (including openings 15' in seal plate faces 155' shift links 15' arm 35' and axle 36*a'*, which correspond to openings 15 in seal plate faces 155*a*, shift link 157, arm 35, and axle 36*a* of the transmission assemblies of FIG. 1) are mounted at the rear of the apparatus, to control rear wheels 25' and 27' (unlike the FIG. 1 embodiment in which the transmission assemblies are mounted in the front of the apparatus, to control front wheels 21 and 23).

Further, in the FIG. 27/28 embodiment, the shape of the turbine assembly housing members (e.g., 12' and 11') differs slightly from the corresponding elements (12 and 11) in FIG. 1.

Also, as shown in FIG. 28, rotatably mounted motion sensor wheel 42' has one or more permanent magnets 44' attached around its rim. A Hall effect transducer (not shown in FIG. 28) is mounted in the dry environment inside control box assembly 14, in a position near the rim of wheel 42'. The Hall effect transducer detects the proximity of each magnet 44' which rotates past it. The output of the Hall effect transducer is processed to convert it to a digital data stream suitable for processing by the microprocessor within the control box assembly. In response to such digital data stream, the microprocessor generates control signals indicating whether the apparatus is moving or stationary. By positioning wheel 42' near side wheels 21' and 25' (rather than at the center of the rear of the apparatus, as is corresponding motion sensor wheel 42 in the FIG. 2 embodiment), improved contact is achieved between the outer rim of wheel 42' and the surface to be cleaned by the apparatus.

Figure 29:
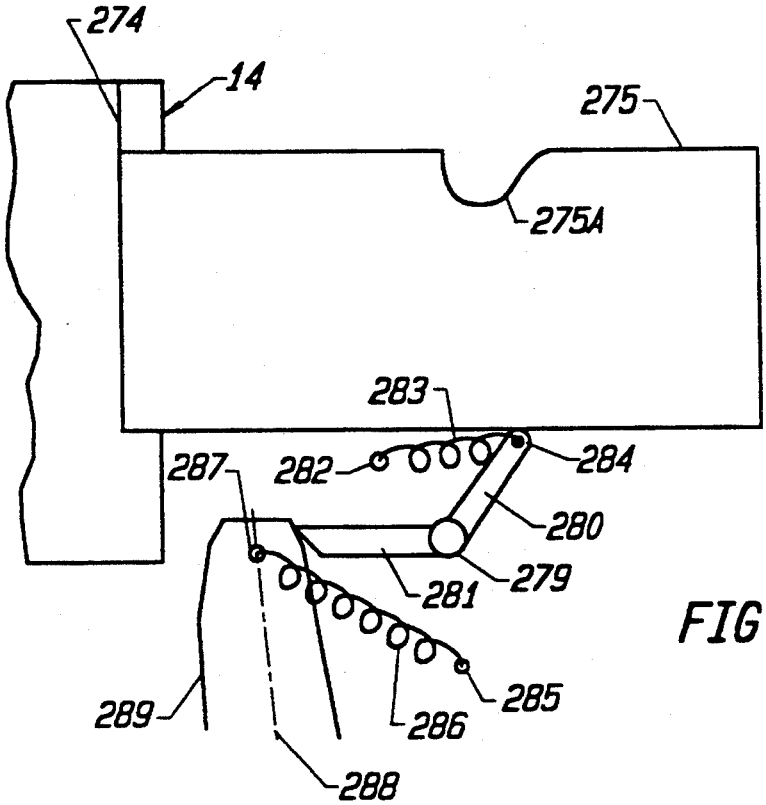
FIG. 29 is a side elevational view of a detail of the FIG. 27 embodiment of the inventive apparatus, in a first position.
Figure 30:
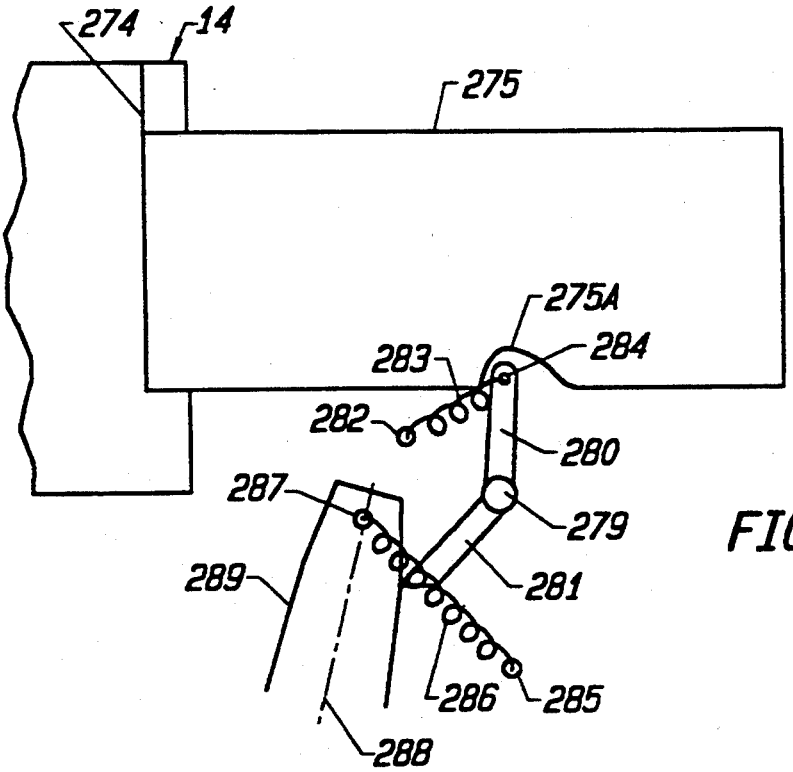
FIG. 30 is a side elevational view of a detail of the FIG. 27 embodiment of the inventive apparatus, in a second position.

Also, in the preferred embodiment of FIGS. 27 and 28, card 275 is inserted against shoulder 274 (shoulder 274 is formed in the side wall of control box assembly 14) to command the microprocessor within control box assembly 14 to cause the apparatus to enter a selected one of its preprogrammed operating modes. Card 275 can be identical to card 275' which was described above with reference to FIGS. 21A and 21B, although above-described card 275' need not have a notched edge (as does card 275, as best shown in FIGS. 29 and 30).

The apparatus of FIGS. 27 and 28 preferably includes a spring-biased rotating assembly (shown in FIGS. 29 and 30) which includes shaft 279 (rotatably mounted to control box assembly 14 in a position near shoulder 274 of FIG. 28), arm 280 (fixedly attached to shaft 279), arm 281 (also fixedly attached to shaft 279), spring 283, and spring anchor 282 (fixedly attached to control box assembly 14). One end of spring 283 is attached to anchor 282 and the other end of spring 283 is attached to anchor portion 284 of arm 280, so that spring 283 exerts a biasing force on arm 280 which urges arm 280 to rotate counter-clockwise (in the plane of FIG. 29).

This apparatus also includes shift lever 289 (rotatably mounted to control box assembly 14 in a position near shoulder 274 of FIG. 28), spring 286, and spring anchor 285 (fixedly attached to control box assembly 14). One end of spring 286 is attached to anchor 285 and the other end of spring 286 is attached to anchor portion 287 of lever 289, so that spring 286 exerts a biasing force on lever 289 urging lever 289 to rotate clockwise (in the plane of FIG. 29). Lever 289 is connected to a means for selecting the size of inlet 9 of turbine assembly 12, in such a manner that lever 289's position mechanically selects one of at least two available inlet sizes. An example of such a size selection means is nozzle plate 9*a*, which is hingedly attached to lever 289 as shown in FIG. 26. When lever 289 is in a first position (e.g., the position shown in FIG. 29), it pulls plate 9*a* into the position shown in FIG. 26 in which relatively small ("standard") orifice 9*c* of plate 9*a* (orifice 9*c* is smaller than inlet 9) is aligned with inlet 9. When lever 289 is in a second position (e.g., the position shown in FIG. 30), it pushes plate 9*a* into another position in which large orifice 9*b* of plate 9*a* (orifice 9*c* is at least as large as inlet 9) is aligned with inlet 9. In general, by increasing the effective size of inlet 9, slower and more thorough cleaning action is achieved (along with an ability to remove larger articles of debris from the surface being cleaned). It will be appreciated that many other types of mechanical linkages could alternatively be employed to allow selection of a desired effective size of inlet 9 from a set of discrete effective sizes (or a continuous range of effective sizes).

With reference again to FIGS. 29 and 30, one edge of card 275 has a notch 275*a*. When card 275 is inserted downward along shoulder 274 in an orientation with notch 275*a* facing upward (as in FIG. 29), the bottom edge of card 275 will engage arm 280, thereby causing the assembly comprising shaft 279 and arms 280 and 281 to rotate clockwise into the orientation shown in FIG. 29. As arm 281 rotates clockwise, it pushes lever 289 in a counter-clockwise direction (overcoming the biasing force exerted on lever 289 by spring 286) until lever 289 reaches the position shown in FIG. 29 (with lever 289's longitudinal axis 288 oriented vertically). In this position, lever 289 mechanically selects a first effective turbine assembly inlet size (for example, by pushing a nozzle plate 9*a* of the type shown in FIG. 26 into a position in which a relatively large orifice 9*b* is aligned with inlet 9).

On the other hand, when card 275 is inserted downward along shoulder 274 with notch 275*a* facing downward (as in FIG. 30), notch 275 prevents the bottom edge of card 275 from engaging arm 280. This allows spring 283 to pull the assembly comprising shaft 279 and arms 280 and 281 counter-clockwise into the orientation shown in FIG. 30. As arm 281 relaxes counter-clockwise, it allows spring 286 to pull lever 289 clockwise until lever 289 reaches the position shown in FIG. 30 (with lever 289's longitudinal axis 288 in a non-vertical orientation). In this position, lever 289 mechanically selects a different effective turbine assembly inlet size (for example, by pulling a nozzle plate 9*a* into the position shown in FIG. 26, thereby aligning a relatively small orifice 9*c* with inlet 9).

In the embodiment of FIGS. 29 and 30, in which lever 289 is connected as shown in FIG. 26 to plate 9*a*, lever 289 and spring 286 are designed so that the default nozzle size is the relatively small ("standard") size determined by orifice 9*c* of plate 9*a*. Only insertion of card 275 downward (into engagement with arm 280) along shoulder 274 in an orientation with notch 275*a* facing upward (as in FIG. 29), will move lever 289 into a position which selects the relatively large nozzle size determined by orifice 9*b* of plate 9*a*.

We next describe a class of preferred embodiments of the inventive magnetic control card (e.g., card 275 or 275'). In these embodiments, when the card is positioned near an array of magnetically actuated switches (which can include Hall effect transducers), the presence or absence of a steel portion of the card (preferably, the tip of one of fingers 278' of steel insert 277' of FIG. 21A) near each switch determines the multi-bit control signal output by the switch array (each switch preferably outputs a control bit signal that is interpreted by the microprocessor as a "zero" or a "one" bit). If the card has a substantially square shape (as does card 277' in FIG. 21A), insert 277' can be shaped to cause the switch array to output four different multi-bit control signals, depending on which of the four card edges (and thus, which of four corresponding patterns of tips of fingers 278') is presented nearest to the switch array (e.g., against the left shoulder 274 in FIG. 21B). Indeed, the card insert is preferably designed to determine eight different multi-bit control signals, depending on which of the card's square faces is presented toward the switch array (e.g., which of its square faces is oriented downward in FIG. 21B) as well as which of the card's four edges is presented nearest to the transducer array.

We contemplate that the onboard microprocessor of the invention can be preprogrammed with many different programs, and that several differently coded magnetic cards may need to be employed to enable the user to select all of such programs. For example, the microprocessor of the invention can be preprogrammed with sixteen different programs, a first card can be designed (e.g., with an appropriately shaped insert) to select any of eight of such programs (e.g., eight programs for cleaning a small pool or a concrete pool), and a second card can be designed to select any of the other eight of such programs (e.g., eight programs for cleaning a large pool or a pool lined with vinyl). Either or both of such cards can have a notch (such as notch 275*a* of FIG. 29) in one or more of its edges.

Another preferred embodiment of the inventive apparatus will be described with reference to FIGS. 31–33. This apparatus includes a nozzle 9' defining an orifice 392 at the inlet of turbine assembly 12, and a mechanical assembly for changing the effective size of the inlet by moving vane 390 between a first position which blocks a relatively small portion of orifice 392 and a second position which blocks a relatively large portion of orifice 392.

Figure 31:
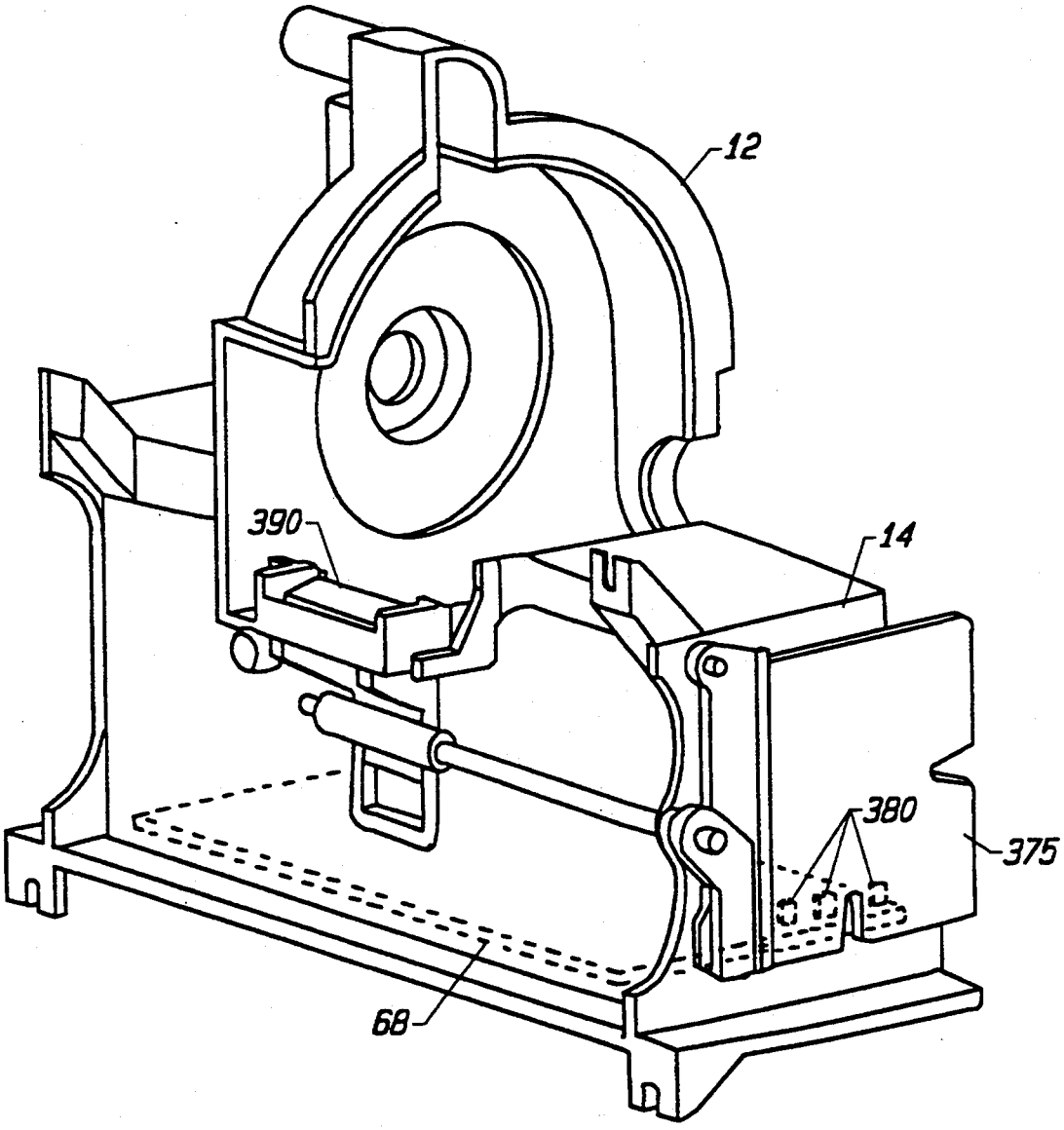
FIG. 31 is a perspective view, partially in cross-section, of a portion of a second preferred embodiment of the inventive apparatus.
Figure 32:
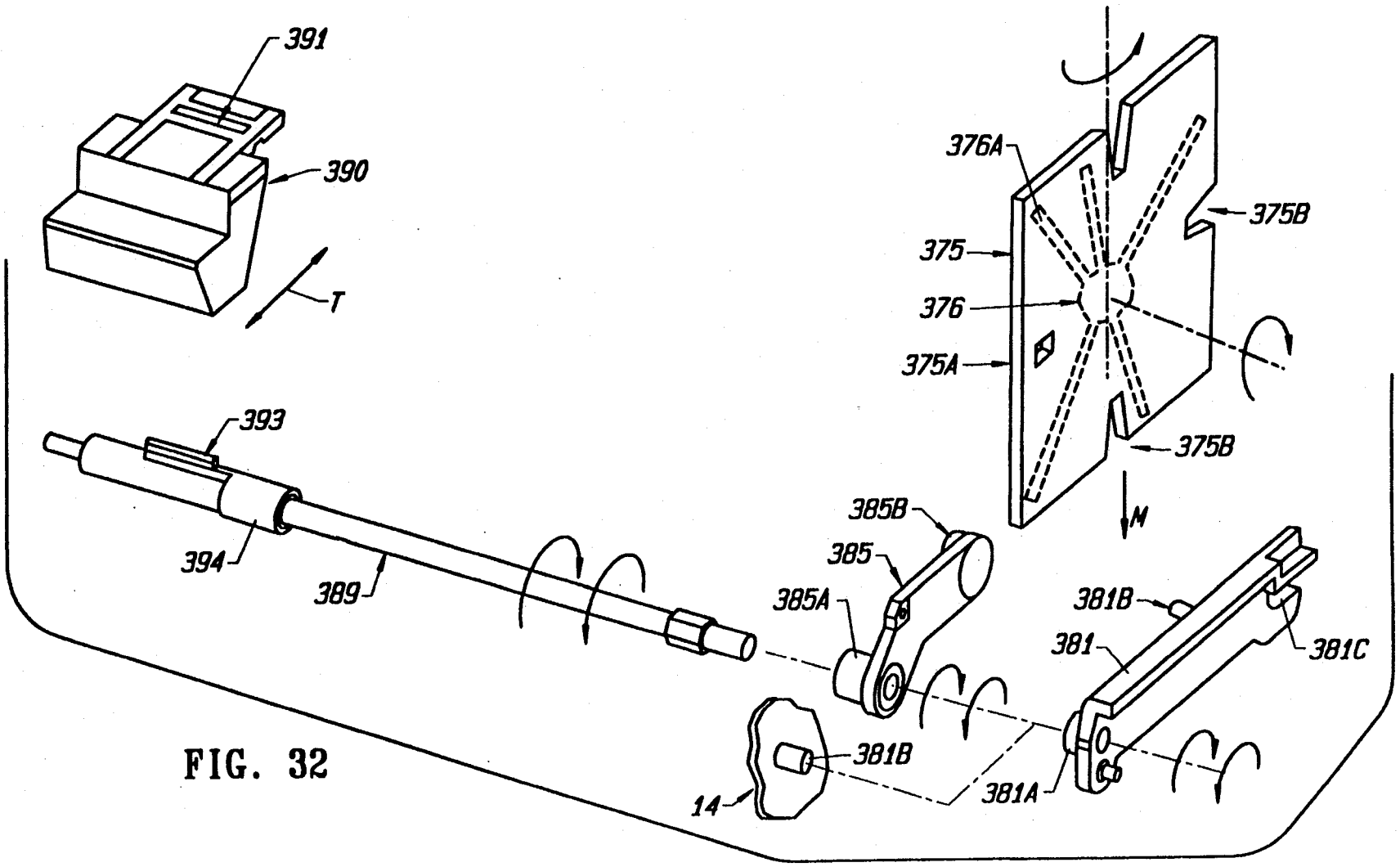
FIG. 32 is an exploded perspective view of a subassembly of the FIG. 31 apparatus for controlling the effective size of a turbine housing inlet.
Figure 33:
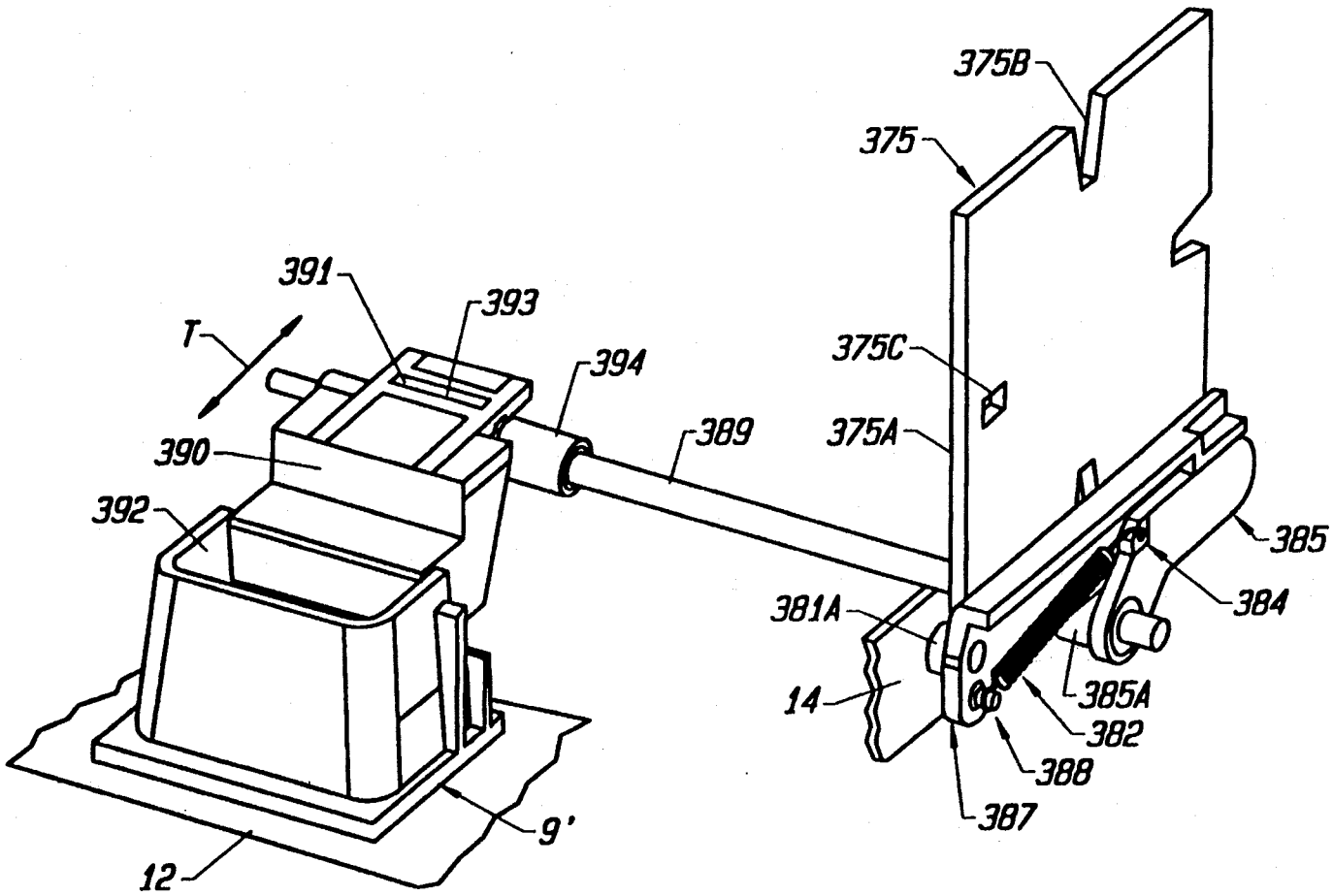
FIG. 33 is a perspective view of the assembled FIG. 32 apparatus, with a turbine housing inlet.

Also in the apparatus of FIGS. 31–33, the wall of control box 14 is designed to receive programming card 375. Card 375 is composed of a square of magnetically permeable material with an insert 376 molded within it, as shown in FIG. 32. Insert 376 (which is preferably made of steel) has a different magnetic permeability than the surrounding portion of card 375 (which can be plastic), and includes a set of fingers 376*a* which extend radially outward from the card center to its edges. When card 375 is positioned against the side wall of control box assembly 14 in the position shown in FIG. 31, magnetic transducers 380 in the dry environment within the sealed walls of control box assembly 14 face the lower edge of card 375. The presence or absence of a portion (e.g., a finger 376*a*) of insert 376 near each transducer 380 causes each transducer 300 to assert a control bit signal to a microprocessor electrically connected to the transducer within control box assembly 14, each of which control bit signals is typically interpreted by the microprocessor as a binary zero or one. The control bit signals simultaneously asserted by all transducers 380 collectively command the microprocessor to execute one of several pre-programmed programs, and thus to operate in one of several corresponding predefined modes. Transducers 380 (which can be reed switches or Hall effect transducers) are electrically connected to circuit board 68 within control box assembly 14.

The mechanical assembly for changing the effective size of the turbine assembly inlet is best shown in FIGS. 32 and 33. This mechanical assembly includes vane 390 (which is free to translate relative to nozzle 9'), shaft 389 (which is rotatably engaged with vane 390), arm 381 (rotatably mounted to the wall of control box assembly 14, and arm 385 (rotatably mounted to arm 381). Specifically, cylindrical portion 381*a* of arm 381 is rotatably attached to pin 381*b* which protrudes from the side wall of control box assembly 14. Spring 382 is connected between spring anchor 388 (protruding out from arm 381) and hole 384 through arm 385, so that spring 382 exerts a biasing force on arm 385 urging arm 385 to rotate counter-clockwise (in the plane of FIG. 33). Pin 385*b*, at one end of arm 385, engages (and rides in) slot 381*c* at one end of arm 381. Thus, as arm 381 rotates (either clockwise or counterclockwise) about sleeve portion 381*a* at its other end, the action of slot 381*c* on pin 385*b* causes arm 385 to rotate in the same rotational direction.

Generally cylindrical sleeve 394 is attached to one end of shaft 389, and has a radially protruding tooth 393. The other end of shaft 389 is fixedly attached to sleeve portion 385*a* of arm 385. Tooth 393 fits in slot 391 of vane 390. When shaft 389 (and hence sleeve 394) rotates about its longitudinal axis, tooth 393 in slot 391 will push vane 390, thereby causing vane 390 to translate (parallel to double arrow T shown in FIG. 33) relative to nozzle 9' of turbine assembly 12.

The shape of card 375's outer edges are employed in the following manner to select the inlet size of turbine assembly 12. As card 375 is inserted (in the direction of arrow M shown in FIGS. 31 and 32) into position facing sensors 380 within control box assembly 14, its leading edge approaches pin 381*b* of arm 381. We contemplate that a latch (not shown) can be provided to releasably lock card 375 in the proper position facing sensors 380 (such latch may engage hole 375*c* which extends through card 375 or it may engage the inner end of card 375's notch 375*b*). If the leading edge of card 375 is not notched (e.g., edge 375*a*), such leading edge will engage pin 381*b* and exert torque on arm 381 to rotate arm 381 clockwise. As arm 318 rotates clockwise, it causes arm 385, shaft 389, and tooth 393 to rotate clockwise (overcoming the biasing force exerted by spring 382 on arm 385), and causes rotating tooth 393 to slide vane 390 in a direction which opens orifice 392 (increasing the effective size of the turbine assembly inlet). If card 375 is then removed (by disengaging any latch which holds it in position and then pulling it opposite to the direction of arrow M), spring 382 will cause arm 385, shaft 389, and arm 381 to rotate counterclockwise back to their original position (thereby causing tooth 393 to slide vane 390 back to its original position covering more of orifice 392, and thus reducing the effective size of the turbine assembly inlet).

As card 375 is inserted (in the direction of arrow M) into position facing sensors 380 within control box assembly 14, and if its leading edge has a notched portion 375*b* aligned with pin 381*b*, the notched leading edge of card 375 will not engage pin 381*b* and will thus not rotate arm 381. As a result, vane 390 will remain in its original position covering a portion of orifice 392, thus maintaining a relatively small effective size of the turbine assembly inlet.

Various other modifications and variations of the described method of the invention will be apparent to those skilled in the art without departing from the scope and spirit of the invention. Although the invention has been described in connection with specific preferred embodiments, it should be understood that the invention as claimed should not be unduly limited to such specific embodiments.

What is claimed is:

1. An apparatus for automatically cleaning an immersed surface, including:

a housing, having an inlet for receiving liquid, and an outlet through which the liquid escapes after flowing through the housing;

a control box attached to the housing, said control box enclosing and sealing an interior region from the liquid, and including at least one sensor mounted in the interior region for generating operation status signals, and a processor mounted in the interior region for generating control signals in response to the operation status signals;

means for cleaning a portion of the immersed surface adjacent to the housing, including a means for pumping the liquid to cause said liquid to flow through the housing from the inlet and out of the housing through the outlet; and traction means attached to the housing, said traction means including:

transmission means operable in response to the control signals for causing the traction means to operate in any of several operating modes in response to the control signals.

2. The apparatus of claim 1, wherein the operating modes include a first mode for translating the apparatus along the surface, and a second mode for turning the apparatus relative to the surface.

3. The apparatus of claim 1, wherein the surface has a perimeter region bounded by a non-horizontal wall, and wherein the processor is programmed to execute a perimeter cleaning operation during which the apparatus executes turns in response to the operation status signals while cleaning the perimeter region.

4. The apparatus of claim 3, wherein the processor is programmed to traverse a serpentine path through the perimeter region during the perimeter cleansing operation.

5. The apparatus of claim 1, wherein the surface includes a non-horizontal wall, and a substantially horizontal floor having a perimeter region which meets the wall, and wherein the processor is programmed to execute a cleaning operation in which the apparatus cleans the perimeter region and at least a portion of the wall in response to the operation status signals.

6. The apparatus of claim 1, wherein the surface includes a non-horizontal wall and a substantially horizontal floor which meets the wall, and wherein the processor is programmed to execute a floor cleaning operation in which the apparatus cleans the floor and avoids the wall in response to the operation status signals.

7. The apparatus of claim 1, also including:

magnetic switch means mounted within the interior region and coupled to the processor, for asserting program selection signals to the processor in response to proximity of a program selection card, composed at least partially of magnetically permeable material, at the magnetic switch means.

8. The apparatus of claim 7, wherein the magnetic switch means is a Hall effect transducer array.

9. The apparatus of claim 7, wherein the control box includes a card receiving portion for receiving the program selection card, and wherein the magnetic switch means is mounted in the interior region adjacent to the card receiving portion.

10. The apparatus of claim 9, wherein the program selection card is polygonal-shaped, and wherein the magnetic switch means asserts different program selection signals to the processor in response to different orientations of the program selection card at the card receiving portion.

11. The apparatus of claim 1, also including:

a rotatably mounted program selection card composed of magnetically permeable material which defines a pattern of holes, wherein rotation of the program selection card with respect to the housing exposes selected sets of the holes to a sensing position in the interior region; and magnetic switch means mounted in the interior region at the sensing position, wherein the magnetic switch means asserts different control signals to the processor in response to proximity of different ones of the selected sets of the holes at the sensing position.

12. The apparatus of claim 11, wherein the program selection card is rotatably mounted within the interior region.

13. The apparatus of claim 1, also including:

a program selection card having a first portion of a relatively low magnetic permeability and a patterned second portion of a relatively high magnetic permeability; and a magnetic switch means mounted within the interior region and coupled with the processor, for asserting a first set of control signals to the processor in response to proximity of the program selection card to the magnetic switch means.

14. The apparatus of claim 13, wherein the magnetic switch means is a Hall effect transducer array.

15. The apparatus of claim 13, wherein the patterned second portion is an insert molded within the first portion.

16. The apparatus of claim 13, wherein the program selection card is polygonal-shaped, and wherein the magnetic switch means asserts different program selection signals to the processor in response to different orientations of the program selection card with respect to the magnetic switch means.

17. The apparatus of claim 16, wherein the program selection card is square-shaped.

18. The apparatus of claim 1, also including:

a wheel rotatably mounted to the housing outside the control box in engagement with the surface, and wherein said at least one sensor includes motion sensor means for generating an output signal indicative of rotation of said wheel and thus translation of the apparatus relative to the surface.

19. The apparatus of claim 1, also including:

a housing pressure sensor for generating a housing pressure signal when fluid pressure within the housing reaches a threshold value.

20. The apparatus of claim 19, also including:

an operation means for receiving the control signals from the processor and operating the apparatus in response to the control signals;

a power supply; and a power control switch for selectively connecting the power supply to the processor, the traction means, and the operation means, wherein the processor is programmed to generate a power control signal for causing the power control switch to connect means and the operation means in response to the housing pressure signal.

21. The apparatus of claim 1, wherein said at least one sensor includes a breach sensor means for generating a breach signal indicative of breach of the apparatus from the liquid.

22. The apparatus of claim 21, wherein the breach sensor means includes a differential pressure sensor, wherein the control box has a wall and a pressure tube port extending through the wall, and wherein the apparatus includes:

a pressure tube for sensing fluid pressure at a first position outside the control box, wherein the pressure tube has a first end at said first position and a second end coupled to the differential pressure sensor;

a pressure tube fitting in the pressure tube port, wherein the pressure tube extends through the pressure tube fitting, and the pressure tube fitting prevents said liquid from entering the interior region; and flow tube means, coupled between the housing, a second location outside the control box, and the differential pressure sensor, wherein said flow tube means indicates to the differential pressure sensor changes in pressure at said second location.

23. The apparatus of claim 22, wherein the flow tube means includes a branched tube having a third end mounted at a third location outside the control box, wherein the second location and the third location are on left and right sides of the control box, respectively.

24. The apparatus of claim 21, wherein the breach sensor means includes a magnetic switch, and wherein the apparatus also includes:

a float means; and a flexible member connected between the float means and the housing, wherein the magnetic switch generates said breach signal when the flexible member occupies a relaxed position adjacent the control box, and wherein the float means allows the flexible member to relax into said relaxed position when said float means breaches the surface of the liquid.

25. The apparatus of claim 1, wherein the inlet has a size, and also including a means for varying the size of the inlet, including:

an apertured plate movably mounted near the inlet; and a mechanical linkage for moving the apertured plate between a first position establishing a first size of the inlet and a second position establishing a second size of the inlet.

26. The apparatus of claim 1, wherein said at least one sensor includes a tilt sensor means for generating an output signal indicative of a tilt angle of the apparatus.

27. The apparatus of claim 26, wherein the tilt sensor means includes a set of mercury switches.

28. The apparatus of claim 1, also including:

a transmission assembly including a cam rotatably mounted within the interior region, and a shift link coupled between the cam and the traction means; and wherein said at least one sensor includes a cam position sensor mounted within the interior region for generating an output signal indicative of orientation of the cam within the control box.

29. The apparatus of claim 1, wherein the traction means includes:

a turbine assembly including an impeller rotatably mounted in the housing, said turbine assembly coupled to the traction means for supplying power to the traction means for supplying power to the traction means in response to flow of fluid through the housing, wherein said at least one sensor includes a turbine speed sensor means for generating an output signal indicative of rotational speed of the impeller relative to the housing.

30. The apparatus of claim 1, also including:

a first program selection card; and magnetic switch means mounted within the interior region and coupled with the processor, for asserting a first set of control signals to the processor in response to proximity of the first program selection card to said magnetic switch means.

31. The apparatus of claim 30, wherein the magnetic switch means is a Hall effect transducer array mounted within the interior region and coupled with the processor.

32. The apparatus of claim 30, wherein the processor is preprogrammed to execute a serpentine, perimeter cleaning operation in response to the first set of control signals.

33. The apparatus of claim 30, also including:

a second program selection card, wherein the magnetic switch means asserts a second set of control signals to the processor in response to proximity of the second program selection card to said magnetic switch means.

34. The apparatus of claim 33, wherein each of the first program selection card and the second program selection card is polygonal-shaped, and wherein the magnetic switch means asserts different program selection signals to the processor in response to different orientations of each said program selection card with respect to said magnetic switch means.

35. The apparatus of claim 11, also including:

a communication port connected to the processor, for receiving remotely generated control signals and forwarding said remotely generated control signals to the processor.

36. The apparatus of claim 1, wherein the surface includes a non-horizontal wall, and a substantially horizontal floor having a perimeter region which meets the wall, and wherein the processor is programmed to execute a cleaning operation in which the apparatus cleans a major portion of the floor including the perimeter region and at least a portion of the wall in response to the operation status signals.

37. An apparatus for automatically cleaning an immersed surface, including:

a housing, having an inlet for receiving liquid, and an outlet through which the liquid escapes after flowing through the housing;

means for cleaning a portion of the immersed surface adjacent to the housing, including a means for pumping the liquid to cause said liquid to flow through the housing from the inlet and out of the housing through the outlet;

a control box attached to the housing, said control box enclosing and sealing an interior region from the liquid, and including a processor mounted in the interior region, wherein the processor is preprogrammed to execute at least two different programs, wherein during execution of each of the programs the processor asserts control signals;

operation means for receiving the control signals from the processor, operating the apparatus in a first operating mode in response to the control signals asserted during a first one of the programs, and operating the apparatus in a second operating mode in response to the control signals asserted during a second one of the programs; and magnetic switch means mounted within the interior region and coupled with the processor, for asserting program selection signals to the processor in response to proximity of a program selection card at said magnetic switch means, wherein the processor executes at least one of the programs in response to said program selection signals.

38. The apparatus of claim 37, wherein the program selection card is composed of first volume of material having a first magnetic permeability and an insert within the first volume, said insert having a second magnetic permeability.

39. The apparatus of claim 38, wherein the material is plastic and the insert is composed of steel.

40. The apparatus of claim 37, wherein the program selection card is material is composed of magnetically permeable material which defines a pattern of holes.

41. The apparatus of claim 37, wherein the magnetic switch means is a Hall effect transducer array.

42. The apparatus of claim 37, wherein the inlet has a size, and also including means for varying the size of the inlet.

43. The apparatus of claim 42, wherein the means for varying the size of the inlet includes:

a nozzle mounted around the inlet a vane translatably mounted to the nozzle; and a mechanical linkage for moving the vane between a first position establishing a first effective size of the inlet and a second position establishing a second effective size of the inlet.

44. The apparatus of claim 42, wherein the means for varying the size of the inlet includes:

an apertured plate movably mounted near the inlet; and a mechanical linkage for moving the apertured plate between a first position establishing a first size of the inlet and a second position establishing a second size of the inlet.

45. The apparatus of claim 44, wherein the mechanical linkage is biased to remain the first position unless displaced from said first position into the second position by insertion of the program selection card against said magnetic switch means.

46. The apparatus of claim 37, wherein the surface has a perimeter region bounded by a non-horizontal wall, wherein the processor is preprogrammed to execute a perimeter cleaning program, and wherein during execution of the perimeter cleaning program the processor asserts control signals causing the operating means to move along a serpentine path while cleaning the perimeter region.

47. The apparatus of claim 37, wherein the operating means includes a motor, wherein the processor is preprogrammed to execute a first program and a second program, wherein during execution of the first program the processor asserts control signals causing the operating means to supply first current level signals to the motor, wherein during execution of the second program the processor asserts control signals causing the operating means to supply second current level signals to the motor, and wherein the motor consumes less power in response to the first current level signals than in response to the second current level signals.

48. The apparatus of claim 37, also including a sealed battery pack which seals batteries from the liquid, and means for supplying power from the batteries to the processor and the operation means.

* * * * *